US005722013A

United States Patent [19]

Nagase et al.

[11] Patent Number: 5,722,013

[45] Date of Patent: Feb. 24, 1998

[54] COLOR IMAGE FORMING APPARATUS HAVING A SUPPORTING MEMBER AND A PLURALITY OF IMAGE EXPOSURE DEVICES MOUNTED INSIDE A CYLINDRICAL IMAGE FORMING BODY

[75] Inventors: Hisayoshi Nagase; Satoshi Haneda; Hiroyuki Tokimatsu; Shuta Hamada, all of Hachioji; Toshihide Miura, Koganei, all of Japan

[73] Assignee: Konica Corporation, Tokyo, Japan

[21] Appl. No.: 612,224

[22] Filed: Mar. 7, 1996

[30] Foreign Application Priority Data

| | | | |
|---|---|---|---|
| Mar. 17, 1995 | [JP] | Japan | 7-058989 |
| Apr. 12, 1995 | [JP] | Japan | 7-087025 |
| Apr. 17, 1995 | [JP] | Japan | 7-090807 |
| Apr. 25, 1995 | [JP] | Japan | 7-101118 |
| Sep. 1, 1995 | [JP] | Japan | 7-225210 |

[51] Int. Cl.[6] ..... G03G 15/00; G03G 15/01

[52] U.S. Cl. ..... 399/112; 399/114; 399/117; 399/118

[58] Field of Search ..... 399/107, 110, 399/111, 112, 117, 118, 125, 178, 130

[56] References Cited

U.S. PATENT DOCUMENTS

| | | | |
|---|---|---|---|
| 5,541,722 | 7/1996 | Ikeda et al. | 399/178 |
| 5,557,394 | 9/1996 | Haneda et al. | 399/41 |
| 5,600,408 | 2/1997 | Horiuchi et al. | 399/39 |
| 5,608,498 | 3/1997 | Nagase et al. | 399/130 |

FOREIGN PATENT DOCUMENTS

| | | | |
|---|---|---|---|
| 5-307307 | 11/1993 | Japan | G03G 15/01 |
| 07-333939 | 12/1995 | Japan . | |

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

An apparatus for forming multi color toner images includes a photoreceptor drum which has an opening at a first end through which an inside of the photoreceptor drum is accessible, and which has an outer surface on which multi color toner images are formed. A supporting member is provided which is capable of being inserted into the inside of the photoreceptor drum through the opening thereof. A cover member is provided on a first end of the supporting member for covering the opening. A plurality of exposing devices are mounted on the supporting member so that the plurality of exposing devices and the supporting member are incorporated inside the photoreceptor drum when the cover member is fixed so as to cover the opening. A plurality of charging devices are provided around the outer surface of the photoreceptor drum for charging the outer surface of the photoreceptor drum. The plurality of exposing devices conduct imagewise exposing inside the photoreceptor drum so as to form a plurality of latent images for plural different colors on the charged outer surface of the photoreceptor drum, and a plurality of developing devices are provided around the outer surface of the photoreceptor drum for developing the plurality of latent images with plural different color toners so that multi color toner images are formed on the outer surface of the photoreceptor drum.

20 Claims, 28 Drawing Sheets

COLOR IMAGE FORMING APPARATUS HAVING A SUPPORTING MEMBER AND A PLURALITY OF IMAGE EXPOSURE DEVICES MOUNTED INSIDE A CYLINDRICAL IMAGE FORMING BODY

BACKGROUND OF THE INVENTION

The present invention relates to an electrophotographic color image forming apparatus in which a plurality of charging means, image exposure means and developing means are arranged around an image forming body and a multi-color toner image is formed by superimposing each mono-color toner image on the image forming body during a single rotation of the image forming body.

The following methods are widely known as multi-color image forming methods:

- a color image forming apparatus in which the same number of photoreceptors, chargers, developing units, etc. as colors necessary for a full color image, are provided, and a multi-color image is formed by superimposing each mono-color toner image formed on a respective photoreceptor on a transfer body;
- a color image forming apparatus in which one photoreceptor is rotated a plurality of times, and charging, image exposing and developing are repeated for each color so that a color image is formed; and
- a color image forming apparatus in which charging, image exposing and developing are successively carried out for each color during one rotation of one photoreceptor so that a color image is formed.

However, in image forming apparatus described above, the color image forming apparatus, in which the same number of photoreceptors, chargers, developing units, etc. as colors necessary for a full color image, are provided, and a multi-color image is formed by superimposing each mono-color toner image formed on a respective photoreceptor on a transfer body, requires that a plurality of photoreceptors and transfer bodies are moved. Accordingly, there is the drawback in which overall dimensions of the apparatus become excessively large. In the color image forming apparatus, in which one photoreceptor is rotated a plurality of times, and charging, image exposing and developing are repeated for each color so that a color image is formed, one charger, one image exposure means, and one photoreceptor are used, resulting in smaller overall apparatus dimensions, however, the formed image size is limited to less than the surface area of the photoreceptor.

In the color image forming apparatus in which charging, image exposing and developing are successively carried out for each color during one rotation of one photoreceptor so that a color image is formed, image formation can be carried out at a higher speed rate. However, it requires that a plurality of chargers, image exposure means, and developing units are arranged around the photoreceptor. Further, there is a possibility that an image exposure optical system is stained by toner leakage from nearby developing units, resulting in deteriorated image quality. In order to avoid the image quality deterioration, it is necessary that the interval between the image exposure means and developing units is increased, resulting in an increased photoreceptor diameter, and in a subsequent increase of overall apparatus dimensions, which are problems. In order to avoid the above-described problems, an apparatus, in which a base body of the image forming body is formed of a transparent material and a plurality of image exposure means are accommodated in the base body, and an image is exposed onto a photoreceptor layer formed on the outer periphery of the image forming body through the base body, is proposed, for example, in Japanese Patent Publication Open to Public Inspection No. 307307/1993.

However, in the image forming apparatus proposed above, since a large number of image exposure means are arranged inside the image forming body, and chargers, developing units, etc., are arranged outside the image forming body, the structure becomes complicated, and therefore, it becomes difficult to attach and detach the developing units, image forming body and image exposure means, resulting in a decrease of ease of operability. Further, it is difficult to maintain the accuracy of positions among the units. These are major problems. Still further, it is difficult to rotate the image forming body and to attach and detach the image forming body, under the condition that the fixed optical system is arranged inside the image forming body.

Specifically, it is necessary that the exposure optical system and the image forming body are highly accurately positioned on the same axis, so that an interval of ±50 μm is formed and maintained between them. Registration of the image exposure, or the position of image formation, changes depending on the interval between the exposure optical system and the image forming body, and the attaching and detaching methods, resulting in an unacceptable color image.

As a result of solutions of the above-described problems and improvement of the apparatus, the first object of the present invention is to provide a highly accurate positioning means for the exposure optical system and the image forming body, and thereby, to provide a color image forming apparatus in which the positional relationship between the exposure optical system and the image forming body can be maintained even during assembly or during operation of the apparatus, and consequently a desirable image can be obtained.

As described above, in the image forming apparatus disclosed in Japanese Patent Publication Open to Public Inspection No. 307307/1993, a plurality of image exposure means is provided close to a leading edge of a converging light transmissive body array, integrally provided with a plurality of light emitting elements, along the inner surface of the photoreceptor drum. In this case, the more the light emitting portion of the leading edge of the converging light transmissive body array is provided close to the inner surface of the photoreceptor drum, an image with higher light utilization efficiency can be obtained. However, in cases where a color image forming apparatus is used for a long period of time, and, for example, the life of the photoreceptor drum or the LED array comes to its limit, the converging light transmissive body array integrally provided with the LED array is also pulled from the photoreceptor drum with the supporting member for replacement. In this case, as described above, since the light emitting portion of the leading edge of the converging light transmissive body array is close to the inner surface of the photoreceptor drum, there is a possibility that the leading edge of the converging light transmissive body array comes into contact with the inner surface of the photoreceptor drum, and these can damage each other. In such cases, when the image exposure process is carried out using the damaged portion, an electrostatic latent image can not be formed due to a change of a predetermined amount of the light, and a correct electrostatic latent image can not be formed due to deformation on the damaged image forming surface. Further, after the image exposure means has been replaced together with the supporting member, it is required that a new image exposure means is inserted into the photoreceptor drum together with the supporting member. Accordingly, even during the insertion operation, there is a possibility that the inner surface of the photoreceptor drum is damaged with the leading edge of the converging light transmissive body array. In such cases, since the image exposure means and the supporting body have been inserted into the photoreceptor drum, the damage to the inner surface of the photoreceptor drum can not be confirmed. Accordingly, since anything unusual on the image is found after a color image formed on a recording sheet has been checked, it requires a longer time to confirm the image deterioration, and the color image forming apparatus is stopped during this confirmation. As described above, there is a disadvantage that an expensive photoreceptor drum is damaged when the converging light transmissive body array, integrally provided with the LED array, is replaced.

The present invention has been accomplished in order to overcome the disadvantage. The second object of the present invention is to protect the inner surface of the photoreceptor safely when an image exposure means is inserted into or removed from the photoreceptor.

Further, in the color image forming apparatus disclosed in Japanese Patent Publication Open to Public Inspection No. 307307/1993, even when a plurality of image exposure means are accurately assembled with respect to the image forming body, a nonuniform image is formed by fluctuations between the exposure optical system and the image forming body due to oscillation or nonuniform rotation of the image forming body when the image forming body is driven. There is a problem that an excellent electrostatic latent image can not be obtained.

As a result of solutions of the above-described problems and improvement of the apparatus, the third object of the present invention is to provide an image forming apparatus in which a highly accurate positional relationship between the exposure optical system and the image forming body is maintained, and consequently an excellent image can be obtained by preventing oscillation between the two units and nonuniform rotation when the image forming body is driven, and specifically, an image forming apparatus in which an excellent color image can be obtained by superimposing toner images on each other.

SUMMARY OF THE INVENTION

The first object of the present invention is attained by a color image forming apparatus in which plural pairs of charging means, image exposure means and developing means are arranged around a cylindrical image forming body, on which a latent image is formed, the image forming body being charged by the charging means, the image forming body being image-exposed by the image exposure means, a toner image being formed on the image forming body by the developing means, and by repeating these procedures, an image being formed by superimposing the toner image on the image forming body, the color image forming apparatus characterized in that: an opening portion is formed on one end of the cylindrical image forming body; the plural pairs of image exposure means are mounted on a supporting member; a cover portion to close the opening portion is formed on one end of the supporting member; and when the cover portion is provided so as to close the opening portion, the supporting member and the plural pairs of image exposure means are mounted inside the cylindrical image forming body.

The first object of the present invention is attained by a color image forming apparatus in which a cleaning unit for cleaning the image forming body, plural pairs of charging means, image exposure means and developing means are arranged around a cylindrical image forming body, on which a latent image is formed, the image forming body being charged by the charging means, the image forming body being image-exposed by the image exposure means, a toner image being formed on the image forming body by the developing means, and by repeating these procedure, an image being formed by superimposing the toner image on the image forming body, the color image forming apparatus characterized in that: the image exposure means is provided on a supporting member to support the image forming body inside the image forming body; a bearing member to combine the supporting member with the image forming body is provided at an end portion of the supporting member and the image forming body; and the inner peripheral surface of the bearing member is fitted with the supporting member and the outer peripheral surface of the bearing member is fitted with the image forming body.

The first object is attained by a color image forming apparatus in which a cleaning unit, for cleaning the image forming body, plural pairs of charging means, image exposure means and developing means are arranged around a cylindrical image forming body, on which a latent image is formed, the image forming body being charged by the charging means, the image forming body being image-exposed by the image exposure means, a toner image being formed on the image forming body by the developing means, and by repeating these procedure, an image being formed by superimposing the toner image on the image forming body, the color image forming apparatus characterized in that: the image exposure means is provided on a supporting member to support the image forming body inside the image forming body; a bearing member, to combine the supporting member with the image forming body, is provided at an end portion of the supporting member and the image forming body; and the inner peripheral surface of the bearing member is fitted with the image forming body, and the outer peripheral surface of the bearing member is fitted with the supporting member.

The second object of the present invention is attained by a color image forming apparatus in which the charging means and the developing means are arranged outside the cylindrical image forming body, the image exposure means being arranged inside the image forming body, the image forming body being charged by the charging means, the image forming body being image-exposed by the image exposure means, a toner image being formed on the image forming body by the development using the developing means, and thereby, an image is formed on the image forming body, the image forming body characterized in that: a support shaft, penetrating the inside of the cylindrical image forming body, is provided; a supporting member to support the image exposure means is inserted into the support shaft from one end of the image forming body; and the support shaft is fixed by a fixing means.

The second object of the present invention is attained by a image forming apparatus in which a plurality of charging means and the developing means are arranged around an image carrier for forming an electrostatic latent image, and a plurality of image exposure means are provided in the image carrier, and the plurality of image exposure means provided in the image carrier, a supporting member to support the plurality of image exposure means, and a protection guide means to protect the inner surface of the image carrier when the supporting member is attached into or detached from the inside of the image carrier together with the plurality of image exposure means, are provided. A plurality of protection guide means to protect the inner surface of the image carrier are radially provided on the supporting member. The protection guide means to protect the inner surface of the image carrier is structured of an elastic member. This protection guide means is provided on the image exposure means in a protruding manner. The plurality of image exposure means and the plurality of protection guide means, provided on the supporting member in the image carrier, are provided in a process unit detachably provided with respect to the image forming body. The apparatus is structured such that the plurality of image exposure means and the plurality of protection guide means, provided in the image carrier, are attached into or detached from the process unit together with the supporting member after the process unit has been removed from the image forming apparatus.

The second object of the present invention is attained by a color image forming apparatus in which a plurality of charging means, image exposure means and developing means are provided around the peripheral surface of the drum-shaped image forming body, toner images are formed on the image forming body when toner images are superimposed on each other on the image forming body by repeating charging, image-exposing and developing during a single rotation of the image forming body, and after that, the toner images are collectively transferred onto a transfer material, the color image forming apparatus characterized in that the image exposure means are integrated with the supporting member and is accommodated in the inside of the image forming body; and the peripheral surface of the image forming body is prevented from being in contact with the supporting member by the protecting members in a plurality of rows provided in the axial direction of the supporting member. Further, the second object of the present invention is attained by a color image forming apparatus in which a plurality of charging means, image exposure means and developing means are provided around the peripheral surface of the drum-shaped image forming body, toner images are formed on the image forming body when toner images are superimposed on each other on the image forming body by repeating charging, image-exposing and developing during a single rotation of the image forming body, and after that, the toner images are collectively transferred onto a transfer material, the color image forming apparatus characterized in that the image exposure means are integrated with the supporting member and are accommodated in the inside of the image forming body; and the inner peripheral surface of the image forming body is prevented from being in contact with the supporting member by the protecting members respectively provided in the direction of the periphery, on an end portion of the inner peripheral surface of an opening side of the image forming body and on an end portion of the outer peripheral surface of the leading edge side of the supporting member.

Further, the second object of the present invention is attained by a color image forming apparatus in which a plurality of charging means, image exposure means and developing means are provided around the peripheral surface of a drum-shaped image forming body, toner images are formed on the image forming body when toner images are superimposed on each other on the image forming body by repeating charging, image-exposing and developing during a single rotation of the image forming body, and after that, the toner images are collectively transferred onto a transfer material, the color image forming apparatus characterized in that: the image exposure means are integrally provided with the supporting member and accommodated inside the image forming body; and the supporting member is inserted into or removed from the image forming body through the guide member detachably provided on the supporting member.

The third object of the present invention is attained by an image forming apparatus in which an image is formed on the image forming body when the charging means and developing means are provided outside the image forming body on which a latent image is formed, and the image exposure means are provided inside the image forming body, the image forming body is charged by the charging means, the image forming body is image-exposed by the image exposure means, and a toner image is formed by the development using the developing means, the image forming apparatus characterized in that: one end portion of the image forming body and one end portion of the image exposure means are held by a common bearing member; the other ends of the image forming body and the image exposure means are respectively held by separate bearing members; and a drive gear for driving the image forming body is provided on the end portion of the image forming body, which is held by the separate bearing member.

Yet further, the third object of the present invention is attained by an image forming apparatus in which an image is formed on the image forming body when the charging means and developing means are provided outside the image forming body on which a latent image is formed, and the image exposure means are provided inside the image forming body, the image forming body is charged by the charging means, the image forming body is image-exposed by the image exposure means, and a toner image is formed by the development using the developing means, the image forming apparatus characterized in that a braking member for braking the image forming body is provided between the image forming body and the image exposure means.

DETAILED DESCRIPTION OF THE PREFERRED EMBODIMENT

Figure 1:
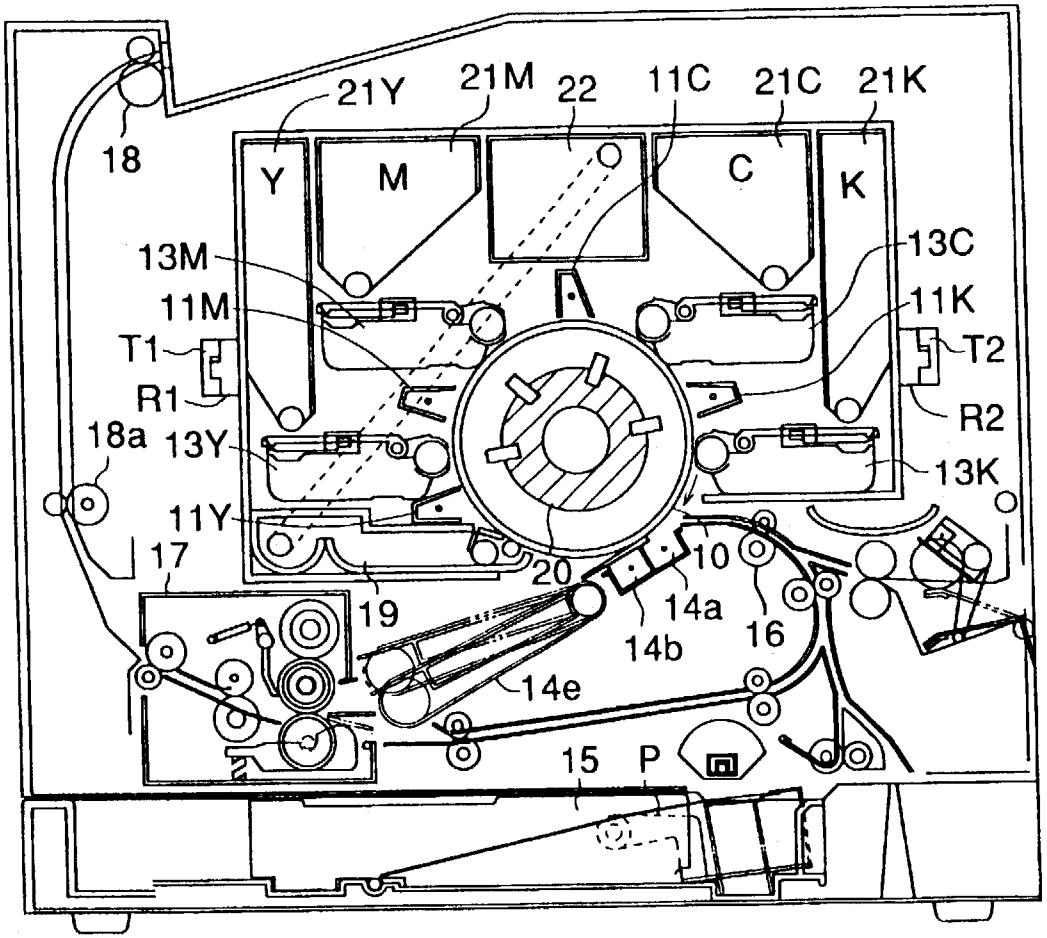
FIG. 1 is a sectional view showing a structure of a color image forming apparatus of an embodiment of the present invention.

Referring to FIG. 1, image forming processes and each mechanism of an embodiment of a color image forming apparatus constituting the present invention will be described below. FIG. 1 is a sectional view showing a structure of the color image forming apparatus of an embodiment of the present invention.

A photoreceptor drum 10, which is an image forming body, is structured as follows. For example, a photoreceptor layer such as an electrically conductive transparent layer, an a-Si layer or an organic photoreceptor layer (OPC) is formed on the outer periphery of a drum, which is a cylindrical base body formed of a transparent member such as optical glass or transparent acrylic resin. The photoreceptor drum 10 is rotated clockwise while electrically grounded.

In the present invention, it is acceptable that a light beam for the image-wise exposure has a quantity of light for exposure, the wavelength of which can apply an appropriate contrast with respect to light beam attenuation characteristics (generation of light beam carrier) of the light conductive layer, in the light conductive layer on the photoreceptor drum which is an image formation point of the exposure light beam for image-wise exposure. Accordingly, it is not necessary that the light transmission ratio of the transparent base body of the photoreceptor drum of the present invention be 100%, and a certain amount of light absorption is acceptable at the time of transmission of the exposure light beam. As the material for the light transmissive base body, the following materials may be used: soda glass, Pyrex glass, boro-silicated glass, or light transmissive resins, used for general optical members, such as fluorine, polyester, polycarbonate, polyethylene terephthalate, etc. As a light transmission conductive layer, any of the following may be used: a light transmissivity-maintaining thin metallic film formed of indium, tin-oxide (ITO), tin oxide, lead oxide, indium oxide, copper iodide, Au, Ag, Ni, Al, etc. For a film forming method, any of the following methods may be used: vacuum evaporation method, active response evaporation method, spattering methods, CVD methods, dip coating method, spray coating method, etc. For a photoconductive layer, the following layers may be used: amorphous silicon (a-Si) alloy photosensitive layer, amorphous selenium alloy photosensitive layer or any type of organic photosensitive layer (OPC).

Scorotron chargers 11Y, 11M, 11C and 11K, which are a charging means, are respectively used for an image formation process of each of yellow (Y), magenta (M), cyan (C) and black (K). A charging operation is carried out on the organic photoreceptor layer of the photoreceptor drum by corona discharging using a control grid and a discharging wire which are maintained at a predetermined potential voltage, and a uniform potential voltage is applied on the photoreceptor drum 10.

Exposure optical systems 12Y, 12M, 12C and 12K, which are an image exposure means, are integrally composed, as a unit, of the following elements: exposure elements such as linear FLs (fluorescent substance light emission), ELs (electroluminescence), PLs (plasma discharge), LEDs (light emitting diode), in which light emitting elements, arranged in the axial direction of the photoreceptor drum 10, are aligned array-like, or the exposure elements such as linear LISA (magneto-optical effect light shutter array), PLZT (transparent piezo-electric element shutter array), LCSs (liquid crystal shutter), in which elements having light shutter function are aligned; and a life-sized image formation element such as a Selfoc lens. The exposure optical systems are mounted on a supporting member 20 provided inside the photoreceptor drum 10. Each color image signal read by an image reading apparatus, which is provided separate from the color image forming apparatus, is successively read from a memory, and respectively inputted into exposure optical systems 12Y, 12M, 12C and 12K as electric signals. As a light emission wavelength of the light emitting elements used in the embodiment, a long wavelength is preferable by considering the light proceeding property of toner, and the wavelength range of 600–900 nm is preferably used.

The developing units 13Y, 13M, 13C and 13K in which a one-component or two-component developer of yellow (Y), magenta (M), cyan (C) and black (K) are respectively accommodated, and which are a developing means using the non-contact developing method, have respective developing sleeves 131Y, 131M, 131C and 131K, which have respectively a predetermined gap with respect to the peripheral surface of the photoreceptor drum 10, and rotate counter to the rotating direction of the photoreceptor drum 10.

Developing units 13Y, 13M, 13C and 13K non-contact reversal-develop an electrostatic latent image on the photoreceptor drum 10 by impression of developing bias voltage, wherein the electrostatic latent image is formed by charging by scorotron chargers 11Y, 11M, 11C and 11K, and image exposing by exposure optical systems 12Y, 12M, 12C and 12K.

With regard to a document image, an image read by an image pick-up element in an image reading apparatus provided separately from the apparatus, or an image edited by a computer is temporarily stored in a memory as an image signal for Y, M, C and K.

When image recording starts, a photoreceptor driving motor rotates the photoreceptor drum 10 clockwise. Simultaneously, a potential voltage is applied on the photoreceptor drum 10 by the charging action of the scorotron charger 11Y.

After the potential voltage has been applied on the photoreceptor drum 10, exposing, due to an electric signal corresponding to the first color signal, that is, a yellow (Y) image signal, starts. Then, an electrostatic latent image corresponding to the yellow (Y) image of the document image is formed on the photoreceptor layer on the drum surface by rotational scanning of the drum.

The latent image is reversal-developed by the developing unit 13Y under the conditions in which developer on the developing sleeve is not in contact with the latent image on the photoreceptor drum 10.

Next, a potential voltage is further applied on the yellow (Y) toner image on the photoreceptor drum 10 by the charging action of the scorotron charger 11M, and the photoreceptor drum 10 is exposed by an electric signal corresponding to an image signal of the second color signal of the exposure optical system 12M, i.e., magenta (M). A magenta (M) toner image is successively superimposed on the yellow (Y) toner image by the non-contact reversal development by the developing unit 13M.

By the same process, a cyan (C) toner image corresponding to the third color signal is successively superimposed on the photoreceptor drum by the scorotron charger 11C, exposure optical system 12C and developing unit 13C, and further, a black (B) toner image corresponding to the fourth color signal is successively superimposed on the photoreceptor drum 10 by the scorotron charger 11K, exposure optical system 12K and developing unit 13K. Thus, a full color toner image is formed on the peripheral surface of the photoreceptor drum 10 during a single rotation of the drum.

The exposure on the organic photoreceptor layer of the photoreceptor drum 10 by the exposure optical systems 12Y, 12M, 12C and 12K is carried out from inside the drum through the transparent base body. Accordingly, the exposure of the images respectively corresponding to the second, third and fourth color signals is carried out without being influenced by any previously formed toner image, and the electrostatic latent image equivalent to the image corresponding to the first color signal can be formed. Highly heat conductive material is used for the supporting member 20 in order to stabilize the temperature inside the photoreceptor drum 10 due to the heat generated by the exposure optical systems 12Y, 12M, 12C and 12K, and to prevent the temperature rise. The temperature inside the photoreceptor drum 10 can be controlled to an appropriate degree by any of the following counter-measures, or similar ones. When the temperature inside the photoreceptor drum 10 is too low, a heater is used, and when it is too high, the heat is dissipated outside the drum through a heat-pipe.

Replenishment developer for each color is respectively replenished from replenishment tanks 21Y, 21M, 21C and 21K to developing units 13Y, 13M, 13C and 13K. With regard to developing operations by developing units 13Y, 13M, 13C and 13K, a developing bias voltage, in which DC and AC voltage are superimposed, is impressed upon each of developing sleeves 131Y, 131M, 131C and 131K; jumping development is carried out by one-component or two-component developer accommodated in the developing units; DC bias voltage, the polarity of which is the same as that of the toner, is impressed upon the photoreceptor drum 10 in which the transparent electrically conductive layer is grounded; and the non-contact reversal development is carried out to cause the toner to adhere onto the exposed portion.

The color toner image thus formed on the outer peripheral surface of the photoreceptor drum 10 is transferred onto a transfer sheet P, in a transfer unit **14*a*, which is a transfer material and which is fed from a sheet feed cassette 15, conveyed on a timing roller 16, and fed to the transfer unit 14*a* by the timing roller 16 in timed relationship with the toner image on the photoreceptor drum 10**.

The transfer sheet P, onto which the toner image has been transferred, is discharged by a discharger **14*b* and is separated from the outer peripheral surface of the drum, and after that, it is conveyed to a fixing unit 17 by a conveyance belt 14*e*. In the fixing unit 17, the toner image is heated and pressure-contacted, causing the toner to be fused and fixed onto the transfer sheet P, and after that, the transfer sheet P is conveyed by a pair of sheet delivery rollers 18*a*, and delivered onto a tray on the upper portion of the apparatus by delivery rollers 18**.

The surface of photoreceptor drum 10, from which the transfer sheet has been separated, is slidably contacted with a cleaning blade **19*a* in a cleaning unit 19, and thus residual toner on the drum surface is removed and the surface is cleaned. The photoreceptor drum 10, then, continues toner image formation according to the document image, or it temporarily stops, and then, starts the new toner image formation according to the new document image. Waste toner, scraped off by the cleaning blade 19*a* and a cleaning roller 19*b*, is delivered to a waste toner container 22 by a toner conveyance screw 19*c*. After cleaning has been completed, the cleaning blade 19*a* and the cleaning roller 19*b* are withdrawn from the photoreceptor drum 10** in order to prevent the photoreceptor drum from being damaged.

Figure 2:
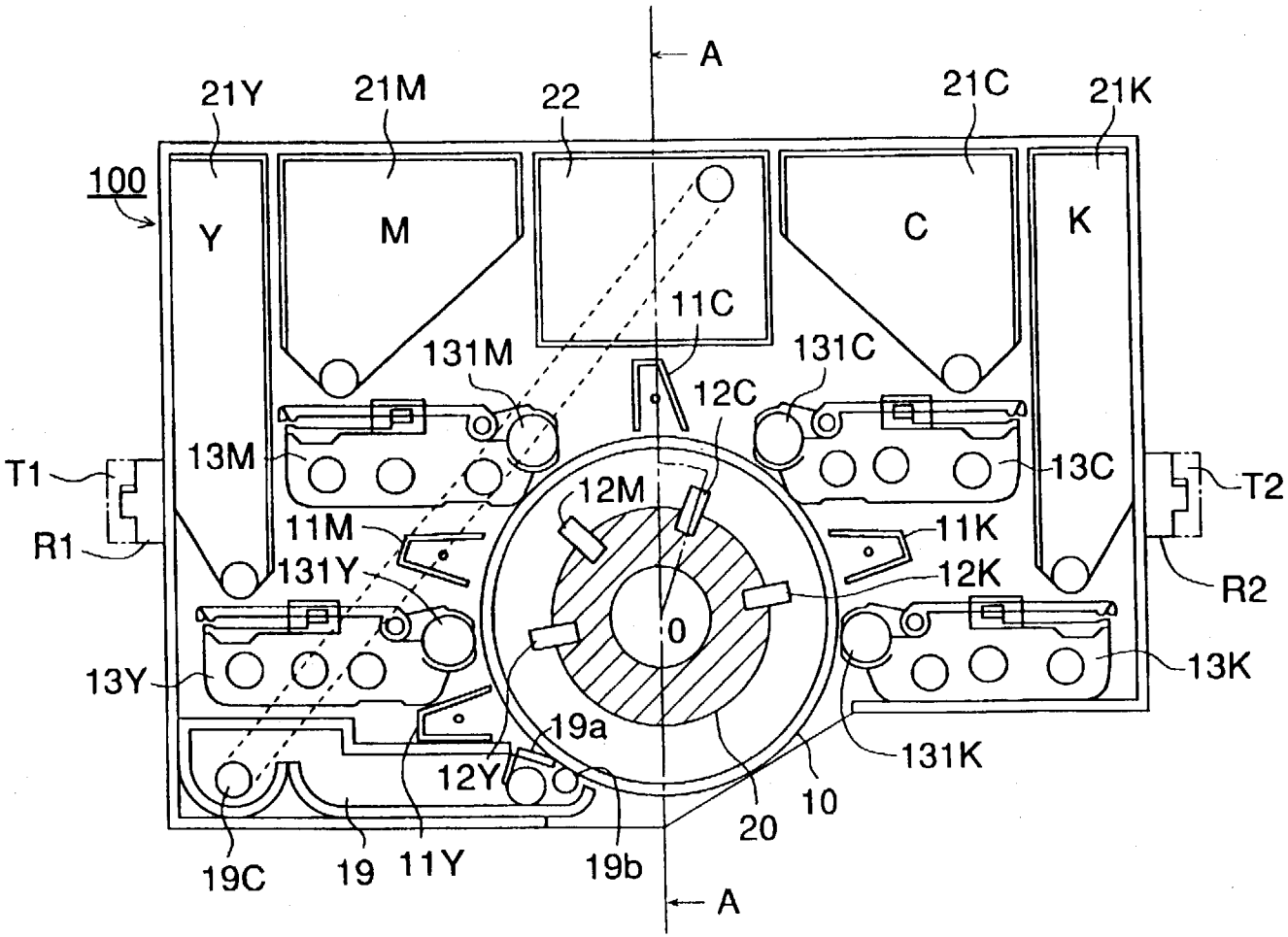
FIG. 2 is a sectional view of a process cartridge according to an embodiment for attaining the first object of the present invention.
Figure 3:
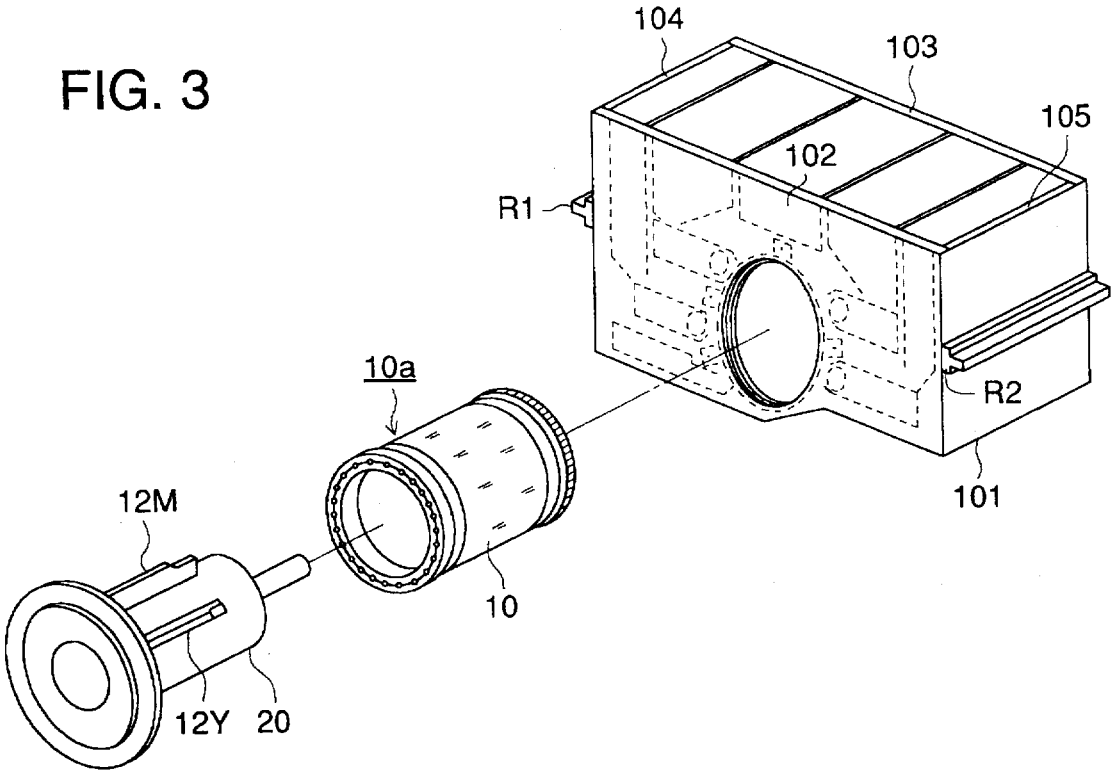
FIG. 3 is a view showing an outline structure for assembling the process cartridge of FIG. 2.
Figure 4:
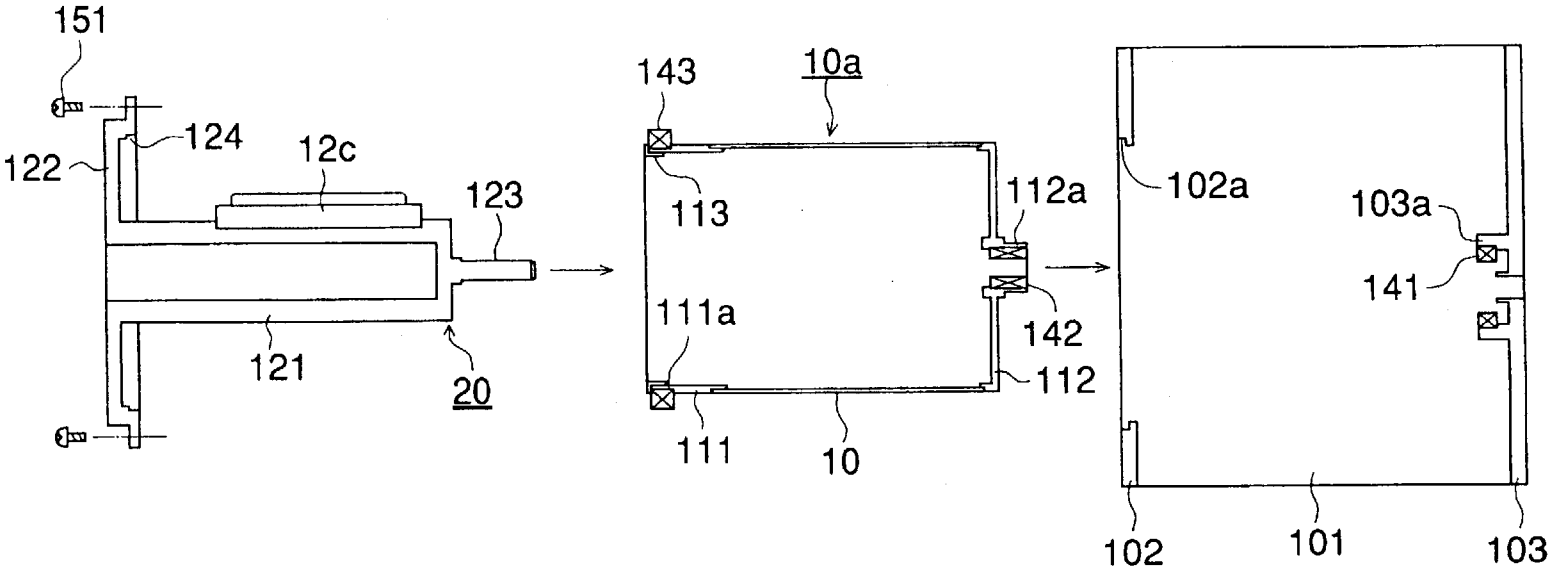
FIG. 4 is a sectional view showing a structure of the main members of FIG. 3.
Figure 5:
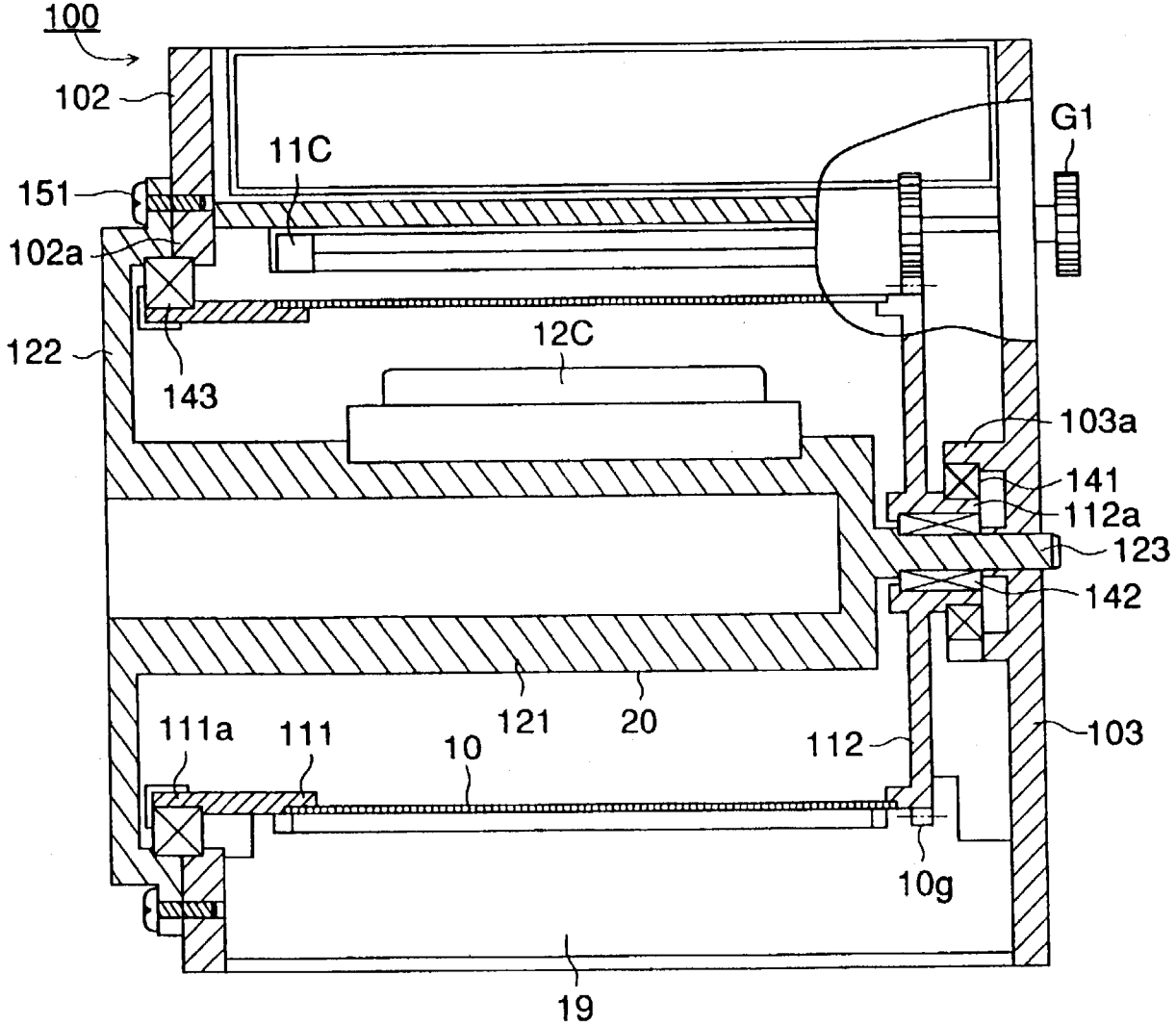
FIG. 5 is a sectional view taken on line A-O-A of the process cartridge of FIG. 2.

Referring to FIGS. 2 through 5, the structure of the main portion of an embodiment of the color image forming apparatus to attain the first object of the present invention will be described below, as a case of a process cartridge 100 to which the present invention is preferably applied. FIG. 2 is a sectional view of the process cartridge provided in the main portion shown in FIG. 1. FIG. 3 is a view of a general structure, showing how the apparatus of the present invention is structured. FIG. 4 is a sectional structural view of a primary member shown in FIG. 3. FIG. 5 is a side sectional view taken on line A-O-A of the process cartridge shown in FIG. 2.

The cleaning unit 19, scorotron chargers 11Y, 11M, 11C and 11K which are the charging means, developing units 13Y, 13M, 13C and 13K which are the developing means, replenishment tanks 21Y, 21M, 21C and 21K, and the waste toner container 22, etc. are located and fixed in the enclosure 101 of the process cartridge 100, wherein the enclosure 101 is integrally formed of the front plate 102 and rear plate 103, and the left plate 104 and right plate 105. A bearing 141 is pressure-fitted into a receiving portion **103*a* of the plate 103 of the enclosure 101**.

The photoreceptor drum 10 is held by a front flange 111 and a rear flange 112, at the end of which a photoreceptor drum driving gear **10*g* is provided. A bearing 142, which is one bearing member, is pressure-fitted into the inner peripheral surface of a receiving portion 112*a* of the rear flange 112. A bearing 143, which is another bearing member, is pressure-fitted onto the outer peripheral surface of a receiving portion 111***a* of the front flange 111, and further, a stop-ring 113 is fitted into the inner peripheral surface of the receiving portion 111*a*, so that the photoreceptor drum unit 10*a* is structured.

A supporting member 20 for the photoreceptor drum is composed of a cylinder portion 121, a shaft 123, and a flange portion 122, and the exposure optical systems 12Y, 12M, 12C and 12K are respectively fixed at appropriate positions.

The photoreceptor drum unit 10*a* is inserted into the enclosure 101 through a hole of the receiving portion 102*a* provided in the front plate 102 of the enclosure 101. The outer peripheral surface of the receiving portion 112*a* of the rear flange 112 of the photoreceptor drum unit 10*a* is inserted into the inner peripheral surface of the bearing 141 provided on the rear plate 103 of the enclosure 101. The peripheral surface of the bearing 143 which is a bearing member, and which is pressure-fitted onto the receiving portion 111*a* of the front flange 111 of the photoreceptor drum unit 10*a*, is fitted into the receiving portion 102*a* of the front plate 102 of the enclosure 101, and the enclosure 101 is combined with the photoreceptor drum unit 10*a*. Half of the width of the bearing 143 is fitted into the receiving portion 102*a*.

The shaft 123 of the supporting member 20, on which the exposure optical systems 12Y, 12M, 12C and 12K are provided, is inserted into the inner peripheral surface of the bearing 142, which is the bearing member provided in the receiving portion 112*a* of the rear flange 112 of the photoreceptor drum 10 under the condition that the exposure optical systems 12Y, 12M, 12C and 12K which are provided on the cylindrical portion 121, are included inside the photoreceptor drum 10. The receiving portion 124 of the flange portion 122 provided at the end portion opposite to the shaft 123 of the supporting member 20, is fitted onto the outer peripheral surface of the bearing 143, which is the bearing member pressure-fitted onto the receiving portion 111*a* of the front flange 111 of the photoreceptor drum 10. The supporting member 20 is fixed by screws 151 to the front plate 102 of the enclosure 101. Thus, the process cartridge 100 is structured.

Under the above conditions, the image exposure means 12Y, 12M, 12C and 12K provided on the supporting member 20, are arranged inside the photoreceptor drum 10. Further, the bearing 142 which is the bearing member to combine the supporting member 20 to the photoreceptor drum 10, and the bearing 143 which is also a bearing member, are respectively provided as follows. The inner peripheral surface of the bearing 142 is fitted onto the shaft 123 of the supporting member 20, and the outer peripheral surface of the bearing 142 is fitted into the rear flange 112 of the photoreceptor drum 10. The inner peripheral surface of the other bearing 143 is fitted onto the front flange 111 of the photoreceptor drum 10, and the outer peripheral surface of the bearing 143 is fitted into the flange portion 122 of the supporting member 20, and these bearings 142 and 143 are respectively provided at both end portions of the supporting member 20 and the photoreceptor drum 10. The axial center of the photoreceptor drum 10 coincides with that of the supporting member 20 on which the exposure optical systems 12Y, 12M, 12C and 12K are provided, and these are fixed under thus positioned conditions. Accordingly, the photoreceptor drum 10 and the exposure optical systems 12Y, 12M, 12C and 12K which are provided on the supporting member 20, are respectively positioned, with bearings 142 and 143 which are bearing members, as the reference.

With regard to both end portions of the supporting member and the image forming body, the inner peripheral surface of the bearing member which combines the supporting member with the image forming body, may be fitted onto the supporting member, and the outer peripheral surface of the bearing member may be fitted into the image forming body. Further, when flange portions are provided on both end portions of the supporting member, and at least one flange portion is provided separately, and is combined with the supporting member, the inner peripheral surface of the bearing member, which combines the supporting member with the image forming body, may be fitted onto the image forming body, and the outer peripheral surface of the bearing member may be fitted into the supporting member, with regard to both end portions of the supporting member and image forming body. As described in this embodiment, the present invention is effective in a combination of the above-described structures as the bearing member, and also in a structure in which the bearing member is used at only one side of the supporting member and the image forming body, and these structures are included in the spirit and the scope of the present invention.

Due to the bearing member, the exposure optical system and the photoreceptor drum, which is the image forming body, are very accurately positioned relative to each other, and the positional relationship between them is maintained even during assembly or operation of the apparatus. Accordingly, highly accurate registration of the exposure optical system is maintained, and the color image formation, by which an excellent superimposed toner image is obtained, can be consistently carried out.

When the process cartridge 100 is mounted in the color image forming apparatus by inserting guide rails R1 and R2 provided on both sides of the process cartridge 100 into the two guide members T1 and T2 provided in the color image forming apparatus, the following operations are carried out. The photoreceptor driving gear 10*g* provided on the rear flange 112 of the photoreceptor drum 10 is engaged with another gear, which is not shown in the drawings, provided in the apparatus main body through a gear G1 provided on the process cartridge 100, and the photoreceptor drum 10 is driven in a highly accurate positional relationship with the exposure optical systems 12Y, 12M, 12C and 12K. When the process cartridge 100 is attached to or detached from the apparatus main body, the transfer unit 14*a*, discharger 14*b*, and transfer belt 14*e* are separated from the photoreceptor drum 10.

In the above embodiment, the supporting method of the photoreceptor drum which is the image forming body, and the supporting member on which the exposure optical system is provided, by the bearing which is a bearing member, is explained using the process cartridge. However, the process cartridge may be structured such that it is attached to and detached from the apparatus rightward or upward in FIG. 1. Further, it is of course obvious that the structure of the present invention is not necessarily limited to the process cartridge, but it can also be used, for example, for mounting the photoreceptor drum and the exposure optical system on the side plate provided in the apparatus main body.

According to the above embodiment, the rotating image forming body and the supporting member, on which the exposure optical systems are provided, are mounted in the apparatus with the bearing member as the reference, so that the exposure optical system and the image forming body are very accurately positioned relative to each other; and the positional relationship between them is maintained even during assembly or operation of the apparatus, so that a color image forming apparatus, by which an excellent image is obtained, can be provided. Specifically, highly accurate registration of the exposure optical system is maintained, and the color image formation, by which an excellent superimposed toner image is obtained, can be carried out. Thereby, the first object of the present invention can be attained.

Figure 6:
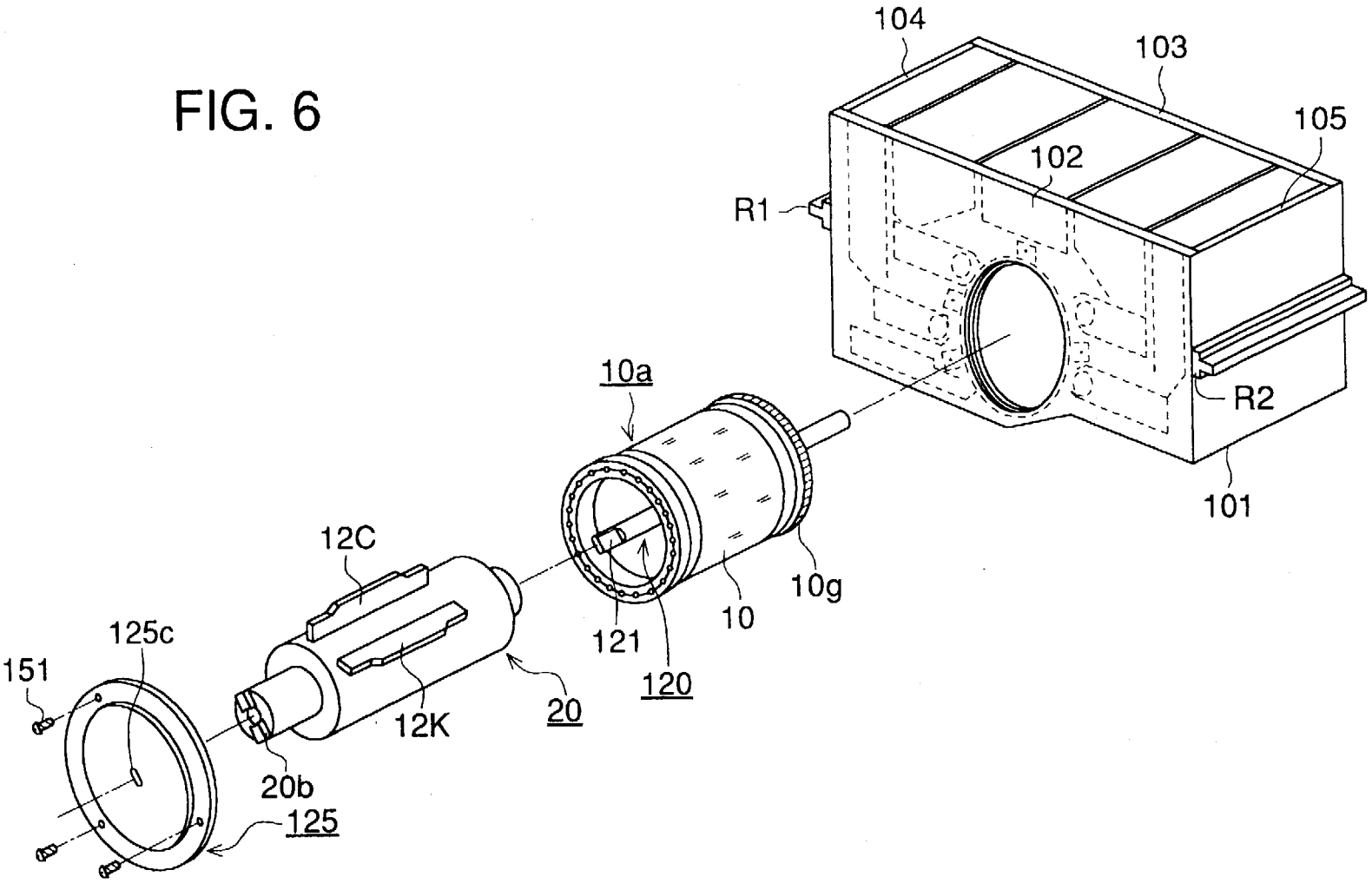
FIG. 6 is a view showing an outline structure for assembling the process cartridge according to an embodiment for attaining the second object of the present invention.
Figure 7:
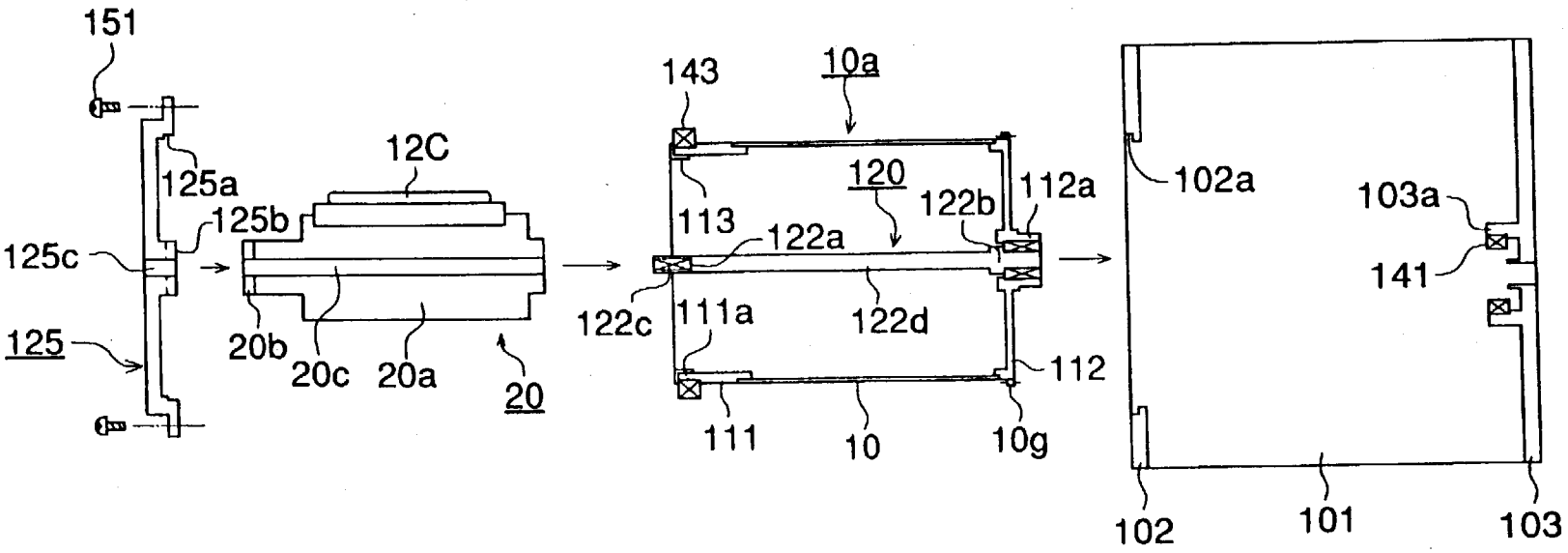
FIG. 7 is a sectional view showing a structure of the main members of FIG. 6.
Figure 8:
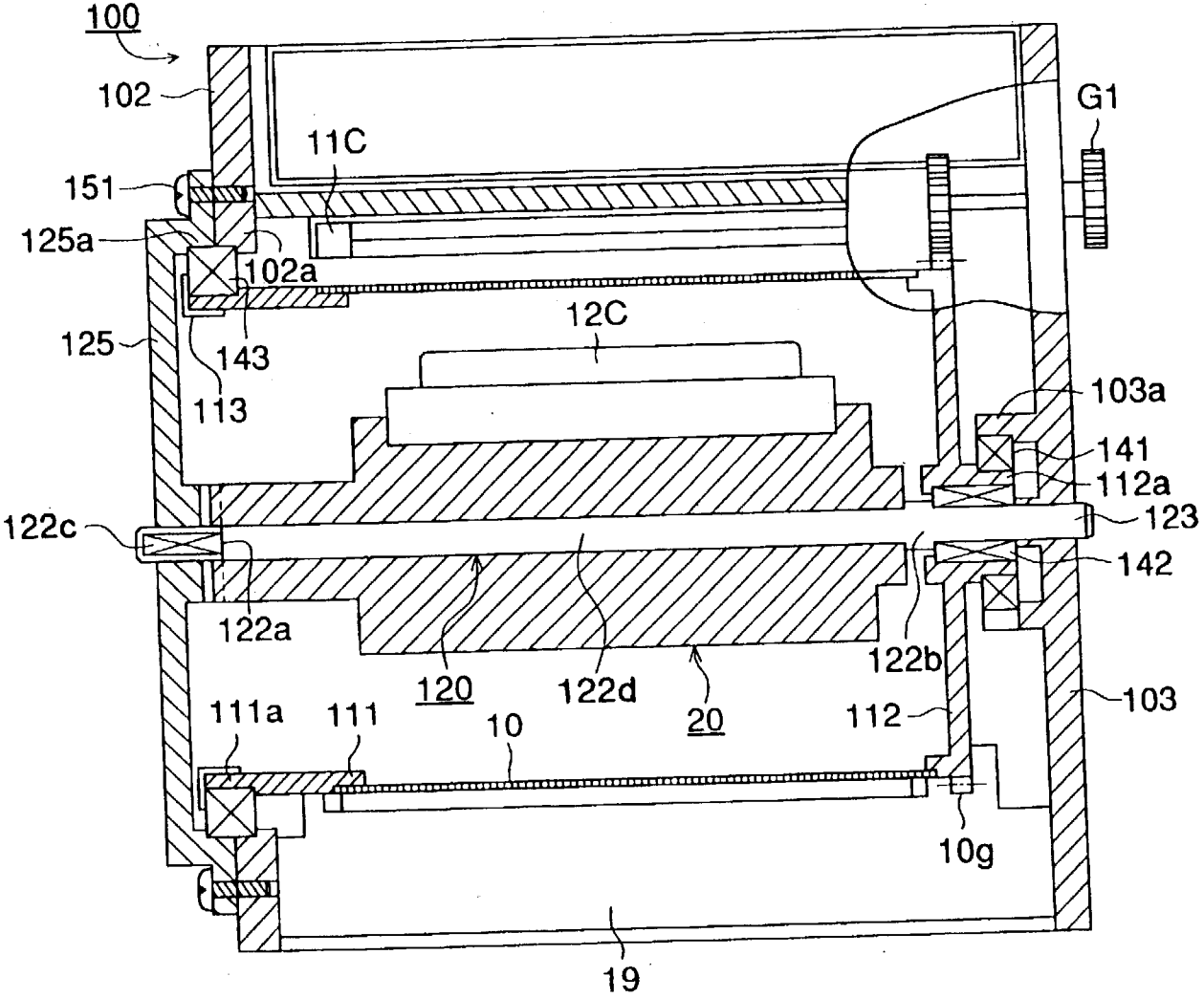
FIG. 8 is a sectional view taken on line A-O-A of the process cartridge of FIG. 2.

Referring to FIGS. 6 to 8, the structure of the main portions of the first embodiment for attaining the second object of the present invention will be described below, using the process unit 100 shown in FIG. 2. FIG. 6 is a view of the outline structure for assembling the apparatus of the present embodiment. FIG. 7 is a sectional view showing the structure of the main members shown in FIG. 6. FIG. 8 is a side sectional view taken on line A-O-A of the process unit shown in FIG. 2.

In this embodiment, a bearing 142 is press-fitted onto a right end portion 123 of a rod-shaped shaft 120, using a collar **122*b* provided on the shaft 120 as a stopper. Further, a bearing 142 is press-fitted into the inner peripheral surface of a receiving portion 112*a* of the rear flange 112 while the shaft 120** is provided in the bearing.

The supporting member 20 is composed of a key **20*b* on the left end portion and a cylindrical portion 20*a*, and the exposure optical systems 12Y, 12M, 12C and 12K are supported by and fixed at respective positions on the cylindrical portion 20*a***.

A center hole **20*c* in the supporting member 20, on which the exposure optical systems are provided, is fitted onto the rod-shaped portion 122 of the shaft 120 provided in the photoreceptor drum unit 10*a*, which is fitted into the housing 101. Thereby, the supporting member 20 is held by the shaft 120**.

Further, a fixing member 125 is fitted on the left end portion of the shaft 120 in such a manner that an oval hole **125*c* provided in the fixing member 125 is engaged with a milled portion 122*c*, a cross section of which is oval, which is provided on the left end portion of the shaft 120 and has 2-flat surfaces, and the oval hole 125*c* approaches to or comes into contact with a stepped portion 122*a* formed between the rod-shaped portion 122*d* of the shaft 120 and the milled portion 122*c*. Further, the receiving portion 125*a* of the fixing member 125 is fitted on the outer peripheral surface of the bearing 143 which is press-fitted onto a receiving portion 111*a* of a front flange 111 of the photoreceptor drum 10. In this case, a key way 125*b* provided in the fixing member 125 is engaged with a key 20*b* provided on the supporting member 20. The fixing member 125, which is a fixing means, is fixed on the front plate 102 of the housing 101 by screws 151 under the condition that the exposure optical systems 12Y, 12M, 12C and 12K provided on the support member 20 are respectively positioned and fixed with respect to other process members, and under the condition that the shaft 120 is prevented from slipping out by the stepped portion 122*a*, and fixed after the flat portion 121 has been engaged with the oval hole 125*c*. The process unit 100** is structured as described above.

Under the above conditions, the fixing member 125 is fixed using the bearing 143, which is a bearing member for the photoreceptor drum 10, as the reference, and the shaft 120 is held by the fixing member 125. The exposure optical systems 12Y, 12M, 12C and 12K, provided on the supporting member 20, which is held by the shaft 120, and the photoreceptor drum 10 are centered using the bearings 141 and 143, which are bearing members of the photoreceptor drum 10, as the reference, and are positioned and fixed.

When maintenance and replacement of the exposure optical system are carried out, screws 151 and the fixing member 125 are removed, and the supporting member 20 on which the exposure optical systems 12Y, 12M, 12C and 12K are fixed, is attached into or detached from the process unit while the supporting member 20 is held by the shaft 120. Accordingly, the supporting member 20 is attached into or detached from the process unit with no possibility that the supporting member 20 comes into contact with the inner surface of the photoreceptor drum 10 and damages the surface, and damages the photoreceptor drum 10. Further, when necessary, the photoreceptor drum 10 is attached into or detached from the process unit for maintenance and replacement.

Figure 9:
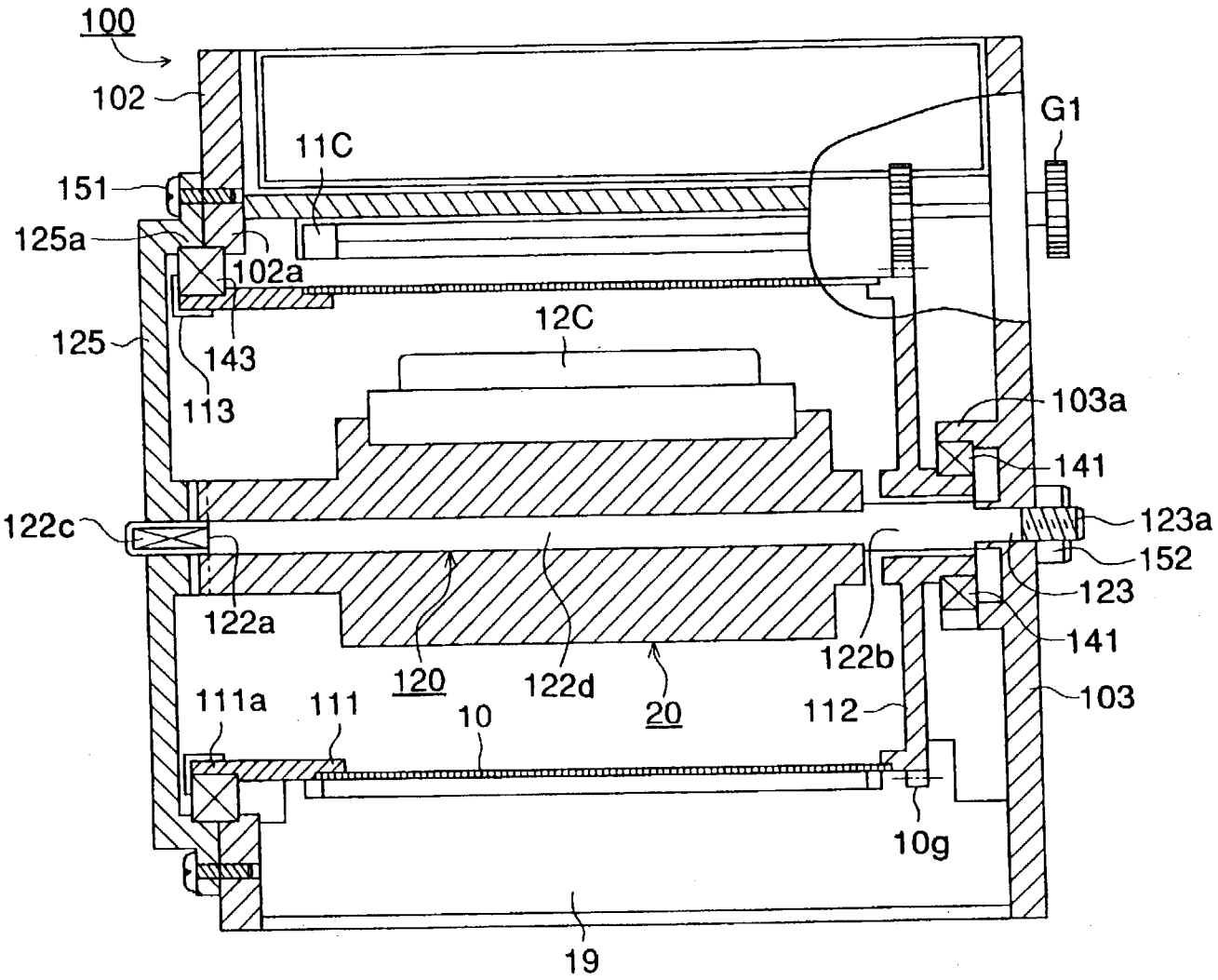
FIG. 9 is a view showing another embodiment of a fixing method of a support shaft.

FIG. 9 shows another example of the fixing methods of the shaft. In this case, the bearing 142 in FIG. 8 is not used, and a screw portion **123*a* is provided on the right end portion 123 of the shaft 120, and the shaft 120 is directly fixed to the rear plate 103 by a nut 152**.

After the shaft 120 has been attached to the housing 101, the photoreceptor drum unit **10*a* is mounted, the supporting member 20 is fitted onto the shaft 120, and the shaft 120 is held and fixed by the fixing member 125**.

In the same manner as described above, when the maintenance and replacement of the exposure optical system are carried out, the screws 151 and the fixing member 125 are removed, and the supporting member 20 on which the exposure optical systems 12Y, 12M, 12C and 12K are fixed, are attached into or detached from the process unit 100 while the supporting member 20 is held on the shaft 120. Accordingly, the supporting member 20 is attached into or detached from the process unit with no possibility that the supporting member 20 comes into contact with the inner surface of the photoreceptor drum 10 and damages the surface, and damages the photoreceptor drum 10. When maintenance and replacement of the photoreceptor drum 10 is carried out, the photoreceptor drum 10 is thus more easily attached into or detached from the process unit than in the case described in FIG. 8.

Figure 10:
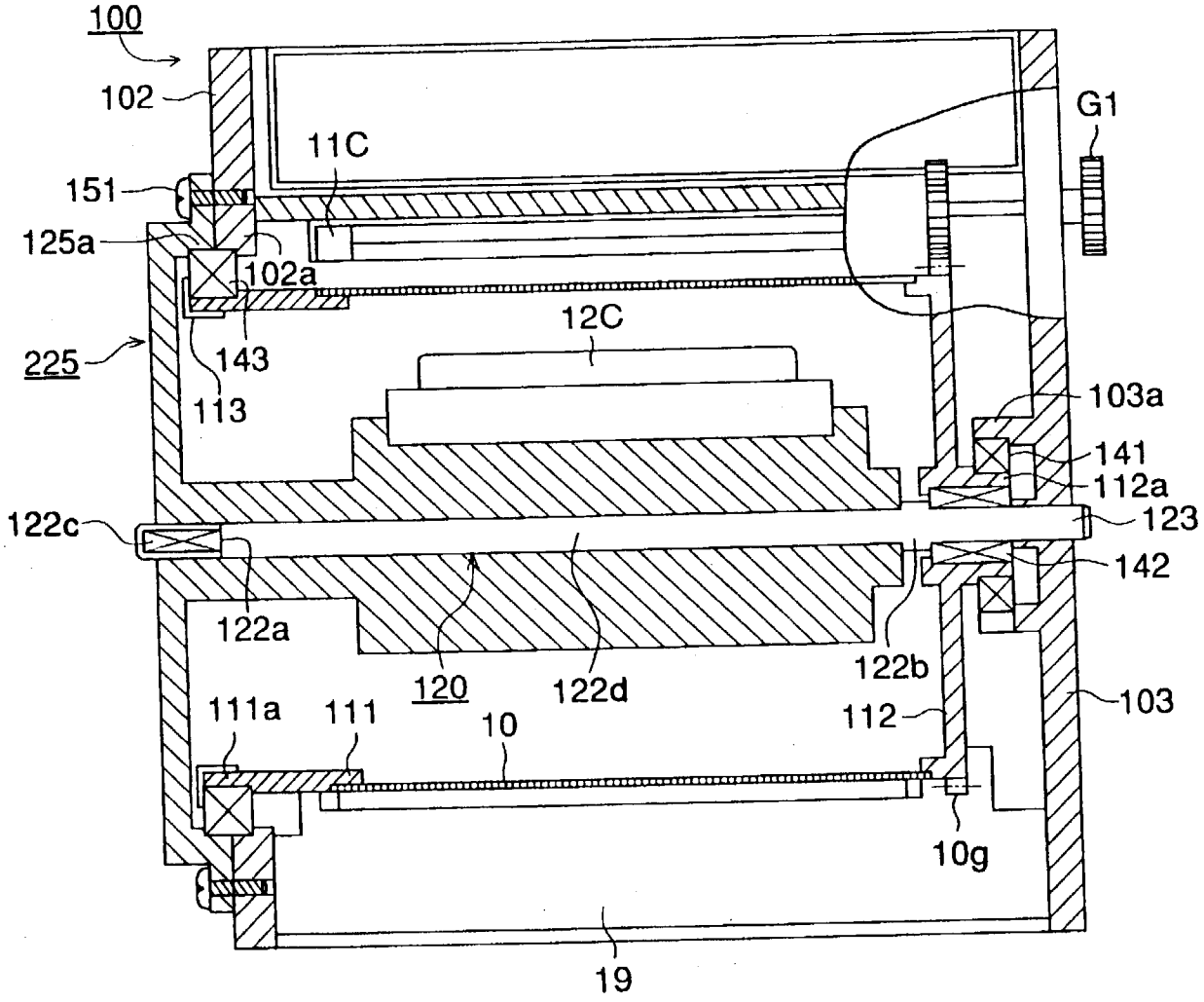
FIG. 10 is a view showing another embodiment of a fixing member.

FIG. 10 shows another example of the fixing member. The fixing member 125 in FIG. 8 is integrated with the supporting member 20 on which the exposure optical systems 12Y, 12M, 12C and 12K are fixed, and a fixing member 225 is provided as a fixing means. Since the functions and the structure in FIG. 10 are the same as those described in FIG. 8, members having the same functions and structures as those in FIG. 8 are denoted with the same numerals.

When the maintenance and replacement of the exposure optical systems are carried out, screws 151 are removed, and the fixing member 225 on which the exposure optical systems 12Y, 12M, 12C and 12K are fixed, is attached into or detached from the process unit while the fixing member 225 is held on the shaft 120. Accordingly, the fixing member 225 is attached into or detached from the process unit with no possibility that the fixing member 225 comes into contact with the inner surface of the photoreceptor drum 10 and damages the surface, and damages the photoreceptor drum 10. Further, as necessary, when maintenance and replacement of the photoreceptor drum 10 is carried out, the photoreceptor drum 10 is attached into or detached from the process unit.

The fixing member 225 is fixed using the bearing 143, which is a bearing member for the photoreceptor drum 10, as the reference, and the shaft 120 is held by the fixing member 225. The exposure optical systems 12Y, 12M, 12C and 12K, provided on the fixing member 225, which is held by the shaft 120, and the photoreceptor drum 10 is centered using bearings 141 and 143, which are bearing embers of the photoreceptor drum 10, as the reference, and are thereby positioned and fixed in place.

Due to the above embodiment, when maintenance and replacement of the exposure optical system are carried out, the supporting member on which the exposure optical systems are fixed, is attached into and detached from the process unit while the supporting member is held by the shaft. Accordingly, the exposure optical systems are attached into or detached from the process unit with no possibility that the supporting member on which the exposure optical systems are fixed, or the exposure optical systems come into contact with the inner surface of the photoreceptor drum and damage the surface, or damage the photoreceptor drum. Further, when necessary, for maintenance and replacement, the photoreceptor drum is easily attached into and detached from the process unit.

The exposure optical systems and the photoreceptor drum, which is an image forming body, are very accurately positioned relative to each other by the bearing members, and the positional relationship between them is maintained even during assembly or use of the apparatus. Therefore, highly accurate registration of the exposure optical systems are maintained, and excellent image formation can be carried out. Specifically, color image formation with excellent superimposed toner images is carried out.

When maintenance and replacement of the exposure optical system are carried out, the fixing member on which the exposure optical systems are fixed, is attached into or detached from the process unit while the fixing member is held by the shaft. Accordingly, the exposure optical systems are easily attached into or detached from the process unit with no possibility that the supporting member on which the exposure optical systems are fixed, or the exposure optical systems come into contact with the inner surface of the photoreceptor drum and damage the surface, or damage the photoreceptor drum. Further, when necessary, for maintenance and replacement, the photoreceptor drum is easily attached into and detached from the process unit.

Referring to FIGS. 11 to 14, the second embodiment for attaining the second object of the present invention will be described.

Figure 11:
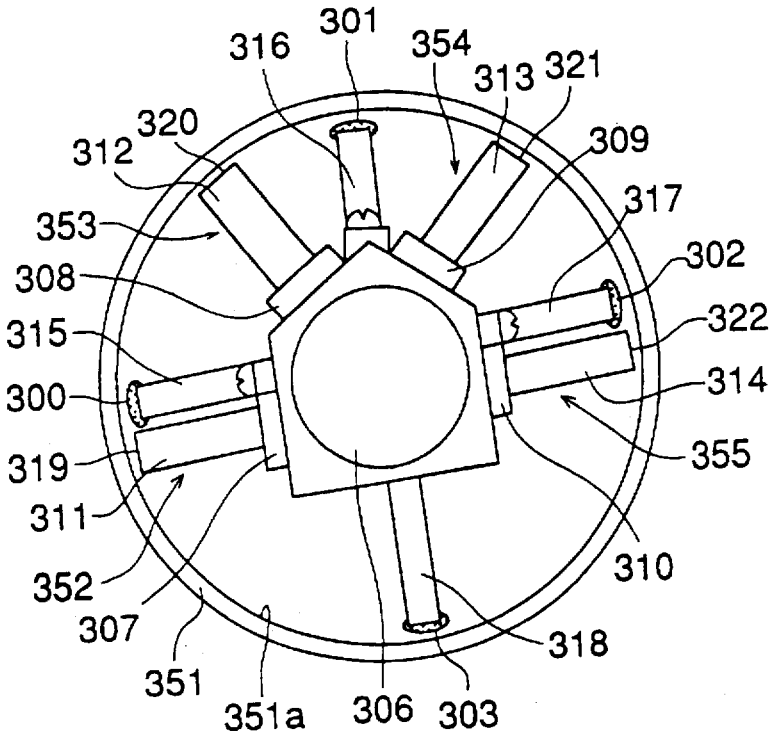
FIG. 11 is a view showing a structure of a protection guide means for protecting an image exposure means of the second embodiment for attaining the second object of the present invention.

FIG. 11 shows a structure in which a plurality of exposure optical systems 352, 353, 354, 355, combined with a converging light transmissive body array which is integrally structured with an LED array of the light emitting element of the present invention, are provided, and protection guide members 300, 301, 302, 303 made of rubber, sponge, resin, etc., to protect the inner surface of the base body of the photoreceptor drum 351 from being damaged, are provided. These are maintained to not contact the inner surface of the base body 351*a*, or are maintained to be in slight contact with the inner surface 351*a*.

In FIG. 11, exposure optical systems 352, 353, 354, 355, in which a plurality of LED arrays 307, 308, 309, 310 and a plurality of converging light transmissive body arrays 311, 312, 313, 314 are integrated, are radially fixed on the supporting member 306 supported by a portion of the process unit 350C shown in FIG. 2. Beams of exposure light respectively emitted from LED arrays 307, 308, 309, 310 expose the photoreceptor drum 351 by the method described in respect to FIG. 1 through the converging light transmissive body arrays 311, 312, 313, 314. Protection guide members 300, 301, 302, 303 are provided on intermediate supporting bodies 315, 316, 317, 318 which are radially projected from and fixed to the supporting member 306. Teflon coating is processed on the surface in which the protection guide members 300, 301, 302, 303 are opposite to the inner surface 351*a* of the base body of the photoreceptor drum 351, so that the surface is smooth.

Figure 12:
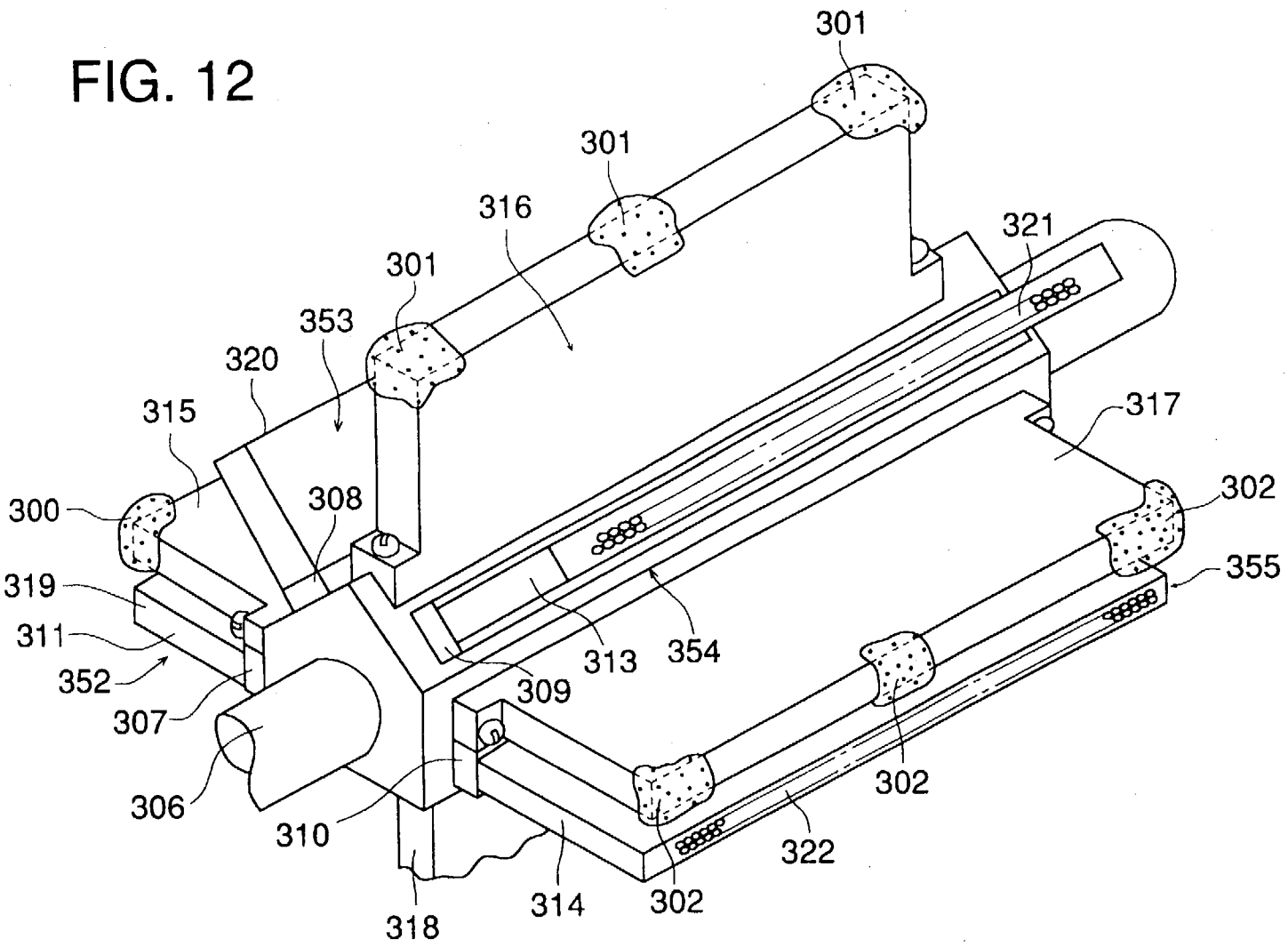
FIG. 12 is a perspective view showing another protection guide means for protecting the image exposure means.

FIG. 12 is a perspective view showing the exposure optical system 352, 353, 354, 355 which are radially fixed on the supporting member 306 as shown in FIG. 11, and the protection guide members 300, 301, 302, 303 which are fixed on the leading edges of the intermediate supporting bodies 315, 316, 317, 318. As shown in the drawing, the protection guide members 300, 301, 302, 303 may be provided such that these members are projected and fixed in the longitudinal direction, on the leading edges of the intermediate supporting bodies 315, 316, 317, 318, or such that these members are projected and fixed on the entire surface in the longitudinal direction. Exposure optical systems 352, 353, 354, 355 and the intermediate supporting bodies 315, 316, 317, 318 which are radially fixed on the supporting member 306, may be detachably hinged, or may be secured with an adhesive agent.

Figure 13:
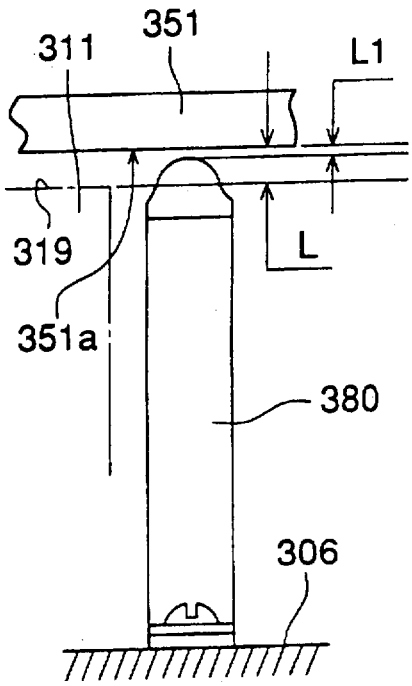
FIG. 13 is a front view showing an embodiment of another protection guide means.
Figure 13:
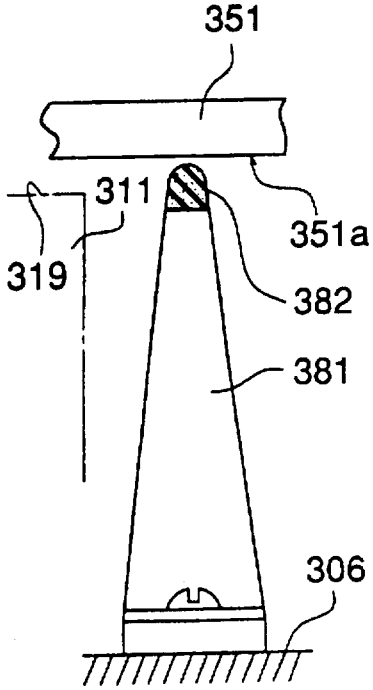
Figure 13:
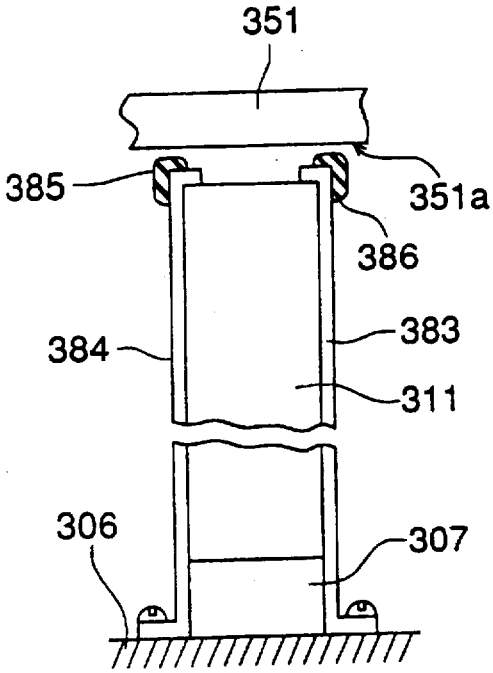

FIGS. 13(*a*), 13(*b*), and 13(*c*) are other examples of the protection guide members 300, 301, 302, and 303. In FIG. 13(*a*), the entire portion of the protection guide member 380 is structured of resin, the base portion of which is fixed on the supporting member 306; the surface facing the inner surface 351*a* of the base body of the photoreceptor drum 351 is formed to be arc-shaped, and TEFLON-coated. As shown in the drawing, when the distance between the light emitting surface 319 of the converging light transitive body array 311 and the inner surface 351*a* of the base body is defined as L, and the distance between the inner surface of the photoreceptor base body 351*a* and the surface of the arc portion of the leading edge of the protection guide member 380 facing the inner surface 351*a* of the base body is defined as L1, the system is structured so that the following relationship is obtained, L>L1

In FIG. 13(*b*), the protection guide member 382 structured of a soft member such as sponge, or the like, is adhered to the leading edge of the intermediate supporting body 381, the base portion which is structured of resin, is fixed on the supporting member 306, and the protection guide member 382 faces the inner surface 351*a* of the photoreceptor drum 351. In the same way as described above, the surface of the leading edge of the protection guide member 382 is TEFLON-coated. In the same manner as in FIG. 13(*a*), when the distance between the light emitting surface 319 of the converging light transmissive body array 311 and the inner surface 351*a* of the base body is defined as L, and the distance between the surface of the leading edge of the protection guide member 382 and the inner surface 351*a* of the base body is defined as L1, the system is structured so that the relationship L>L1 is maintained.

In FIG. 13(*c*), intermediate supporting bodies 383 and 384 are structured such that each end of the intermediate supporting bodies is fixed on the supporting member 306; these intermediate supporting bodies are extended to one end portions of the converging light transmissive body array 311 along the LED array 307 and the converging light transmissive body array 311 under the condition that the light emitting surface 319 is open, and then fixed; and each portion of these supporting bodies 383 and 384 faces the inner surface 351*a* of the base body. Protection guide members 385 and 386, formed of rubber and resins, are adhered at positions, which face the inner surface 351*a* of the base body, on the leading edges of the intermediate supporting bodies 383 and 384, and the surface facing the inner surface 351*a* of the base body is TEFLON-coated. In the same manner as in FIG. 13(*a*), when the distance between the light emitting surface 319 of the converging light transmissive body array 311 and the inner surface of the base body 351*a* is defined as L, and the distance between the surface of the top portion of the protection guide member 385 and the inner surface 351*a* of the base body is defined as L1, the system is structured so that the relationship L>L1 is maintained.

Due to protection guide members 380, 382, 385 and 386 in the example structured as above, a predetermined gap is always formed between the light emitting surfaces 319, 320, 321, 322 of the converging light transmissive body arrays 311, 312, 313 314, which constitute exposure optical systems 352, 353, 354, 355 together with the supporting member 306, and the inner surface 351*a* of the base body.

Figure 14:
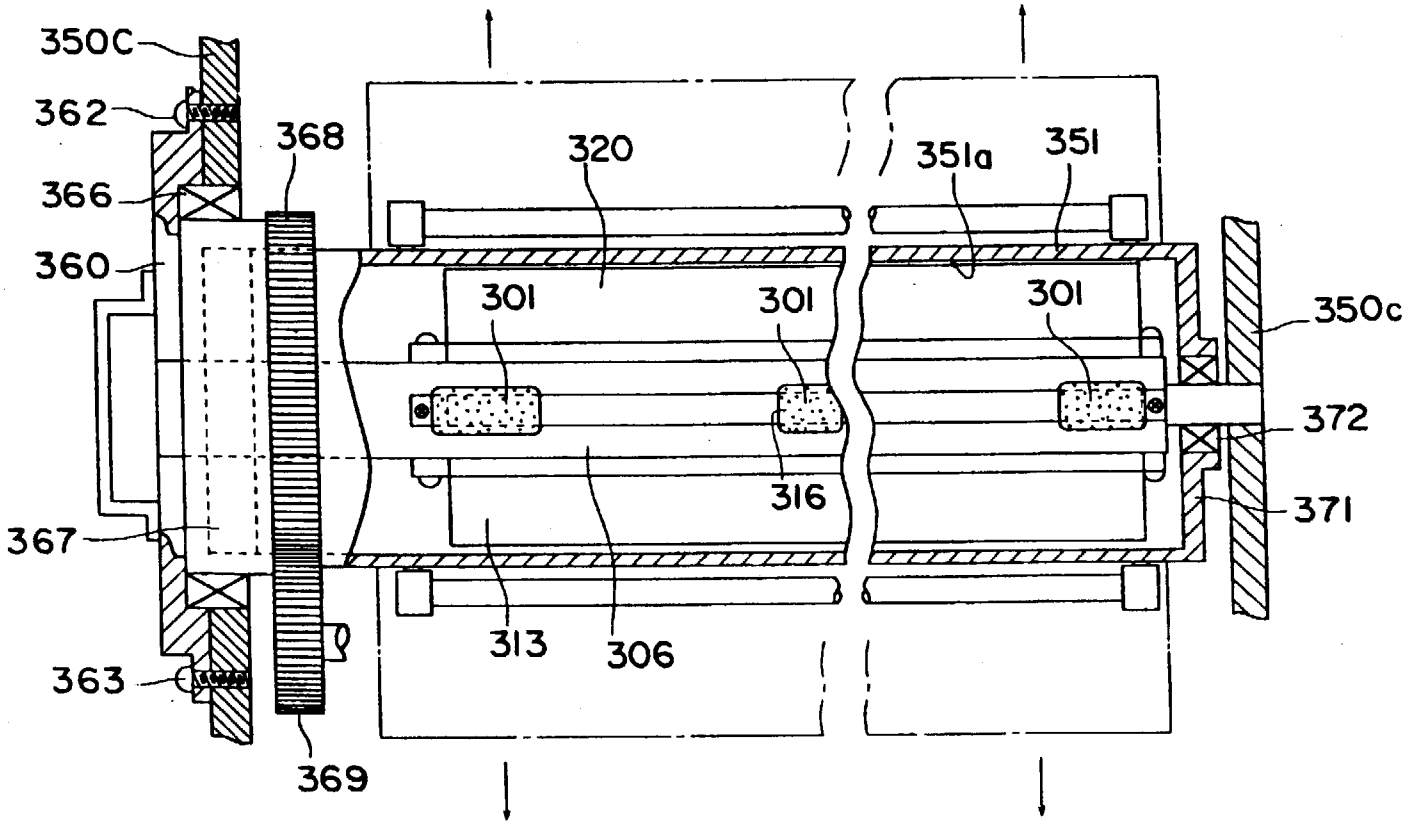
FIG. 14 is a sectional view showing a process unit.

FIG. 14 is a lateral sectional view of the process unit 350*c*. One end of the photoreceptor drum 351 is engaged and held by a cylindrical holding member 367 which is rotatably supported by a bearing 366 supported by the process unit 350*c*, and is provided with a gear 368. The gear 368 is provided with a driving gear 369 to drive the photoreceptor drum 351. As shown in the drawing, the other end of the photoreceptor drum 351 is rotatably supported by the supporting member 306 supported by the process unit 350*c*, and a bearing 372 and a flange 371 provided on the supporting member 306. One end of the supporting member 306 is integrally fixed with a flange 360 which is fixed to the process unit 350*c* by screws 362 and 363.

For example, when it comes time for replacement of the LED array provided on the supporting member 306, the process unit 350*c* is pulled out from the image forming apparatus shown in FIG. 1; the flange 360 fixed by screws 362, and 363 is removed from the process unit 350*c*; and LED arrays 307, 308, 309, 310, shown in the perspective view in FIG. 12, the converging light transmissive body arrays 311, 312, 313, 314, and the protection guide members 300, 301, 302, 303 provided on the intermediate supporting bodies 315, 316, 317, 318, are moved outside together with the supporting member 306 fixed on the flange 360. In this case, initially, the protection guide members 300, 301, 302, 303 come into contact with the inner surface 351*a* of the base body of the photoreceptor drum 351, and the top portions of the converging light transmissive body arrays 311, 312, 313, 314 are not in contact with the inner surface 351*a* of the base body. When the LED arrays 307, 308, 309, 310 have been replaced, and the LED arrays 307, 308, 309, 310, and the converging light transmissive arrays 311, 312, 313, 314 are inserted into the photoreceptor drum, initially, as described above, the protection guide members 300, 301, 302, 303 come into contact with the inner surface 351*a* of the base body of the photoreceptor drum 351, and therefore, the top portions of the converging light transmissive body arrays 311, 312, 313, 314 do not contact the inner surface 351*a* of the base body.

Since the surfaces of the protection guide members 300, 301, 302, 303 are TEFLON-coated and smooth, the inner surface 351*a* of the base body is not damaged even in case of inadvertent contact.

In the present invention, the image carrier is not limited to a photoreceptor drum, but may also be a belt-shaped photoreceptor. Further, the present invention is not limited to the electrophotographic apparatus, but it may be applied to an image forming apparatus in which a photosensitive material such as silver halide is held on the transparent base body, and the image exposure means of blue(B), green (G), red (R) are used.

As described above, in the above embodiment, since a plurality of image exposure means are accommodated in the image carrier, and when the image exposure means are attached to or detached from the image carrier together with the supporting member, the top portions of the image exposure means are guided on the inner surface of the image carrier by the protection guide means. Accordingly, since there is no possibility that the top portions of the image exposure means come into contact with the inner surface of the image carrier, and damage or scratch the inner surface, an expensive image carrier can therefore be used for a long period of time.

When a plurality of the protection guide members are provided radially, the plurality of the protection guide members slide along the inner surface of the image carrier, and a gap between tops of the plurality of image exposure means and the inner surface of the image carrier is uniformly maintained. Accordingly, when the image exposure means are attached to or detached from the image carrier together with the supporting member, the inner surface of the image carrier is not damaged.

Since the surface of the protection guide members are TEFLON-coated and smooth, and easily slide along the inner surface of the image carrier, the inner surface of the image carrier is not damaged.

In the gap between the protection guide means and the inner surface of the image carrier, and the gap between the top of the image exposure means and the inner surface of the image carrier, when the width of a gap between the protection guide member and the inner surface of the image carrier is reduced, the top of the image exposure means is positively prevented from coming into contact with the inner surface.

When the process unit, in which the image carrier on which the electrostatic latent image is formed, a plurality of image exposure means which are supported by the supporting member in the image carrier, and a plurality of protection guide members, are accommodated, is provided in the image forming apparatus, and when the process unit is structured so as to be easily inserted into and detached from the image forming apparatus, initially, the process unit is taken out from the image forming apparatus, and then, the plurality of image exposure means, supported by the supporting member in the photoreceptor drum are withdrawn from the process unit together with the plurality of protection guide members, in the case where the image exposure means are replaced. Accordingly, the image exposure means can be taken out safely and accurately.

While referring to FIGS. 15 to 19, the third embodiment to attain the second object of the present invention will be described below.

Figure 15:
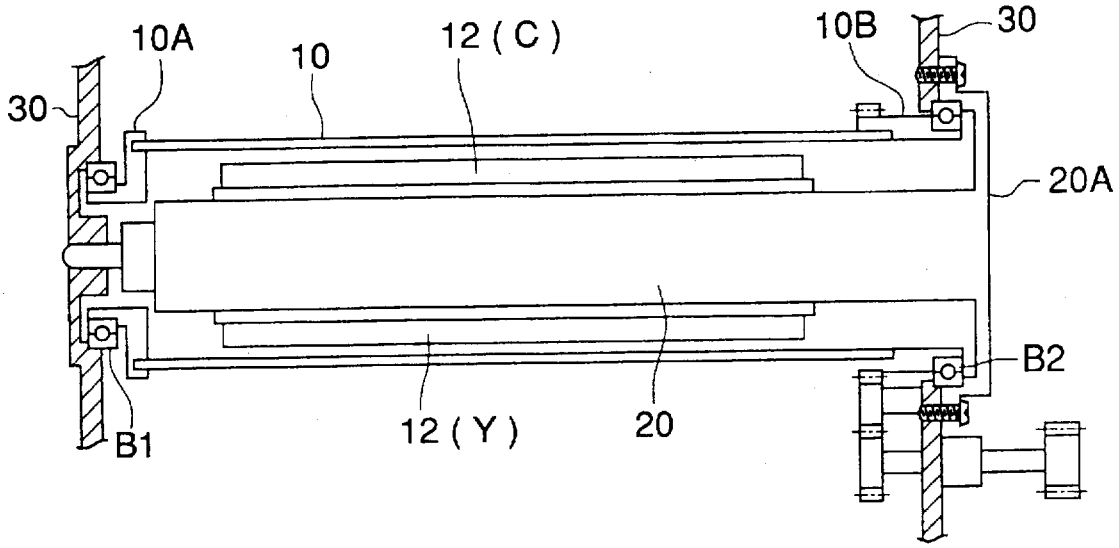
FIG. 15 is a sectional view showing the structure in which a photoreceptor drum and an exposure optical system are assembled, in the third embodiment for attaining the second object of the present invention.

FIG. 15 is a sectional view of the process unit, taken on line AA in FIG. 2. The photoreceptor drum 10 is supported such that: a flange member 10A provided on the front end portion of the photoreceptor drum 10 is directly supported by the wall surface of the process cartridge 30 by a bearing B1; and a flange member 10B on the rear end portion is supported by a bearing B2 which is sandwiched and held between the process cartridge 30 and a flange portion 20A of the supporting member 20 which can be attached to and detached from the cartridge 30.

Accordingly, when the flange portion 20A is removed, the photoreceptor drum 10 and the exposure optical systems 12 are easily taken out from the rear side of the process cartridge 30.

Figure 16A:
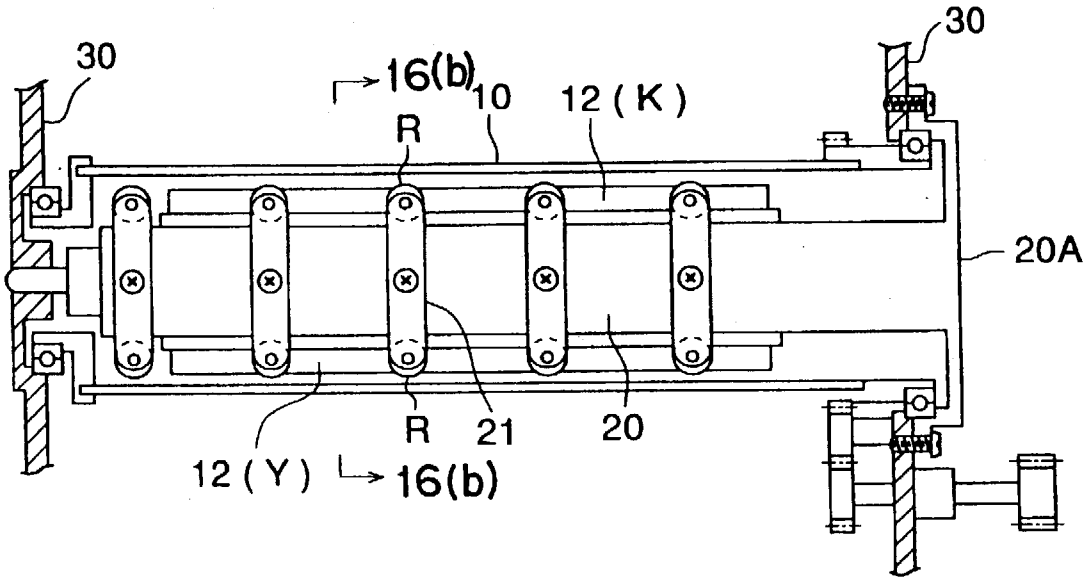
FIGS. 16(*a*) and 16(*b*) are views showing the structure of a protection member of the image exposure means.
Figure 16B:
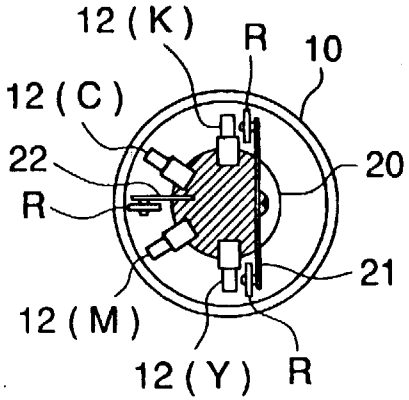
Figure 17:
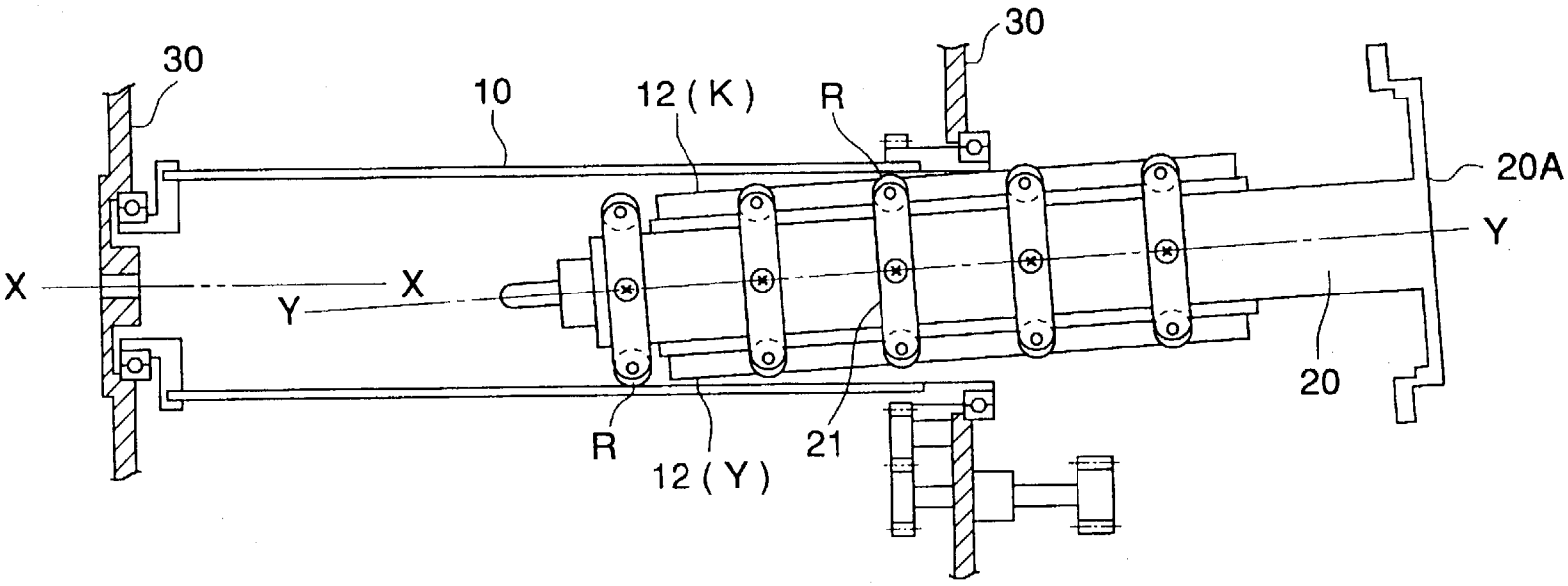
FIG. 17 is a view showing an operation of the protection member of the image exposure means.

As shown in FIG. 16(*a*) and 16(*b*), a plurality of roller supporting plates 21 are provided on main portions in the axial direction of the supporting member 20. Rotation members provided on both end portions of the roller supporting plates, that is, rotatable rollers R, are positioned close to the exposure optical systems 12(Y) and 12(K). Further, a plurality of roller supporting plates 21, on which rollers R are rotatably provided, are inserted and fixed on main portions in the axial direction in the intermediate portion between the exposure optical systems 12(M) and 12(C).

The apex of each roller R is positioned slightly outside the end surface of the exposure optical system 12, and a required minimum gap is maintained with respect to the inner peripheral surface of the drum base body so that the rotation of the photoreceptor drum 10 is not affected.

In case of insertion into or removal from the photoreceptor drum 10, even when the axial center YY of the supporting member 20 is inclined with respect to the axial center XX of the drum, the inclination angle of the supporting member 20 is limited when a pair of rollers R, which are facing each other, provided on the roller supporting plates 21, come into contact with the drum base body. Thereby, the exposure optical systems 12(Y) and 12(K) are prevented from coming into contact with the interior of the drum base body. That is, each roller R is used as a protection member of the exposure optical system 12.

In the same manner, the exposure optical systems 12(M) and 12(C) are prevented from coming into contact with the drum base body when the inclination angle is limited by contact of rollers R provided on the roller supporting plate 21 and roller supporting plate 22.

In this connection, as protection members for the exposure optical systems 12, elastic members having a cushioning effect, or so-called sliding members having smaller frictional resistance, may be used in place of the above-described rotation members.

Figure 18:
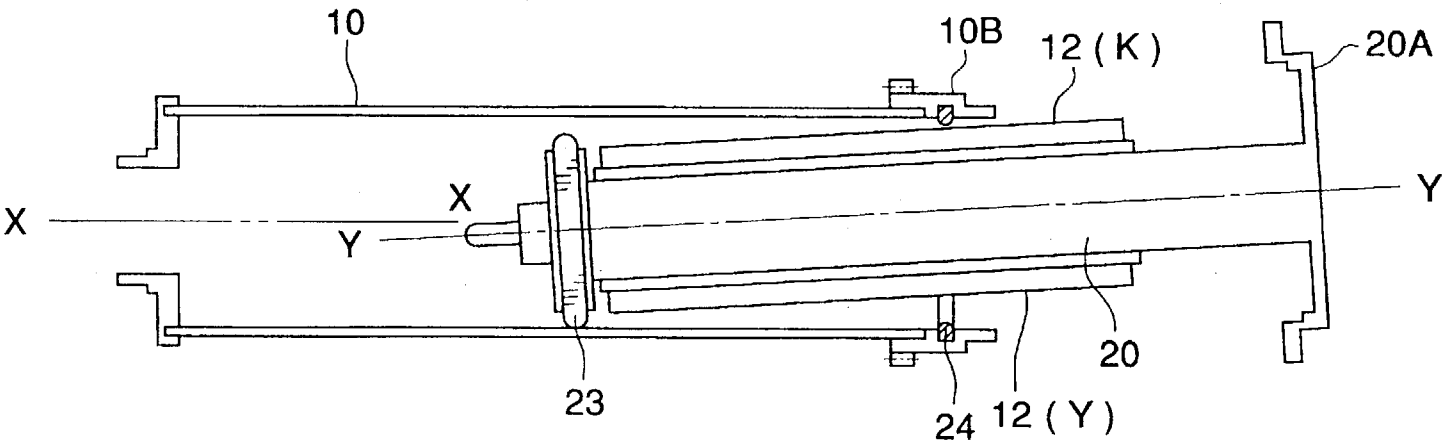
FIG. 18 is a view showing an operation of the protection member of the image exposure means.

FIG. 18 is a modified example of the third embodiment.

In FIG. 18, the supporting member 20 is provided with a ring-shaped elastic member 23 as a protection member on the outer peripheral surface of the leading edge portion, for insertion into the photoreceptor drum 10. The photoreceptor drum 10 is also provided with a ring-shaped elastic member 24 as another protection member on the inner peripheral surface of the flange member 10B provided on the end portion of the opening side.

The outer peripheral surface of the elastic member 23 is positioned a little outside the surface of the top edge of the exposure optical system 12. The elastic member 24 is positioned a little inside the inner peripheral surface of the drum base body of the photoreceptor drum 10, and the inner diameter of the elastic member 24 is set a little larger than the outer diameter of the elastic member 23.

Even if the axial center YY of the supporting member 20 is inclined with respect to the axial center XX of the drum when the supporting member 20 is inserted into or removed from the photoreceptor drum 10, the elastic member 23 elastically comes into contact with the inner peripheral surface of the drum base body, and the elastic member 24 elastically comes into contact with the top portion of the exposure optical systems 12, so that the drum base body is prevented from being in contact with the exposure optical systems 12. Accordingly, scratching, or the like, does not occur on the inner surface of the drum base body during replacement or maintenance operations of the supporting member.

As protection members for the exposure optical systems 12, smoothing members having smaller frictional resistance may be used other than the above-described elastic members. For the elastic members 23, a plurality of rotation members such as rollers, or the like, may be arranged around the periphery.

Figure 19:
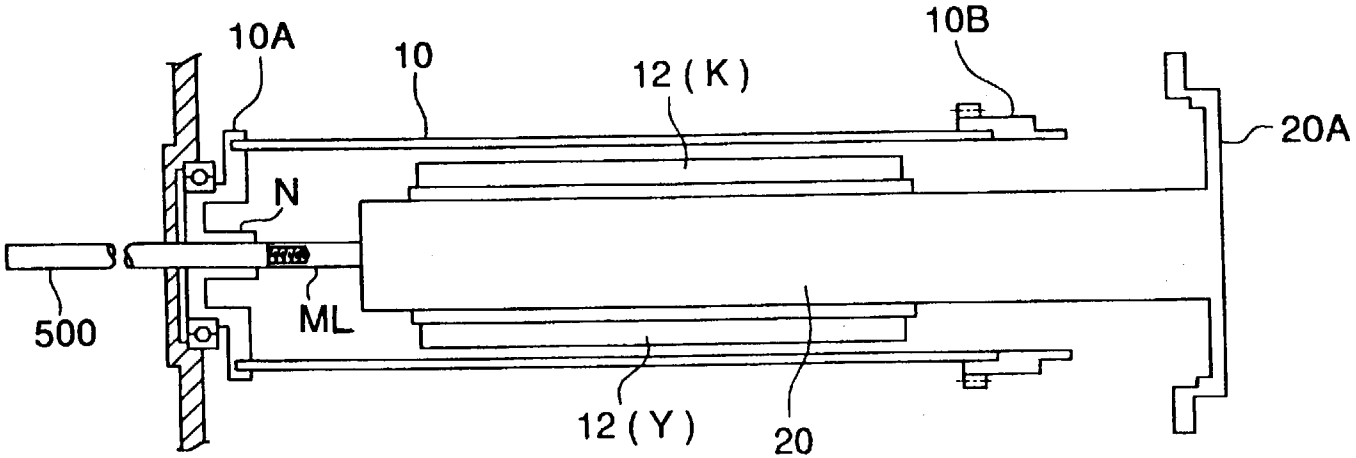
FIG. 19 is a view showing an operation of a guide member of the image exposure means.

FIG. 19 shows a modified example of the third embodiment.

In FIG. 19, a cylindrical portion N, into which the leading end portion ML of the supporting member 20 is inserted, is formed at the axial center portion of the flange member 10A of the photoreceptor drum 10. The leading end portion M of the supporting member 20 is inserted into the cylindrical portion N, and held by the wall surface of the process cartridge 30.

A screw hole is provided on the end surface of the leading end portion M, and a guide member 500, provided separate from the cartridge 30, is screwed from the outside of the cartridge 30 and is then integrated with the cartridge 30.

When the supporting member 20 is inserted into or removed from the photoreceptor drum 10, the direction for insertion and removal of the guide member 100 is limited by the insertion into the N portion, and the supporting member 20 is moved while the axial center of the supporting member 20 coincides with that of the photoreceptor drum 10. As a result, the supporting member 20 is safely and securely inserted into or removed from the photoreceptor drum 10 without contacting the drum base body.

Due to the above embodiment, the image exposure means can be easily and safely inserted into or removed from the drum-shaped image formation body without any possibility of causing scratches or any other damage. As a result, an extremely useful color image forming apparatus is provided in which high quality image formation is assured and also a compact image formation section is realized.

Figure 20:
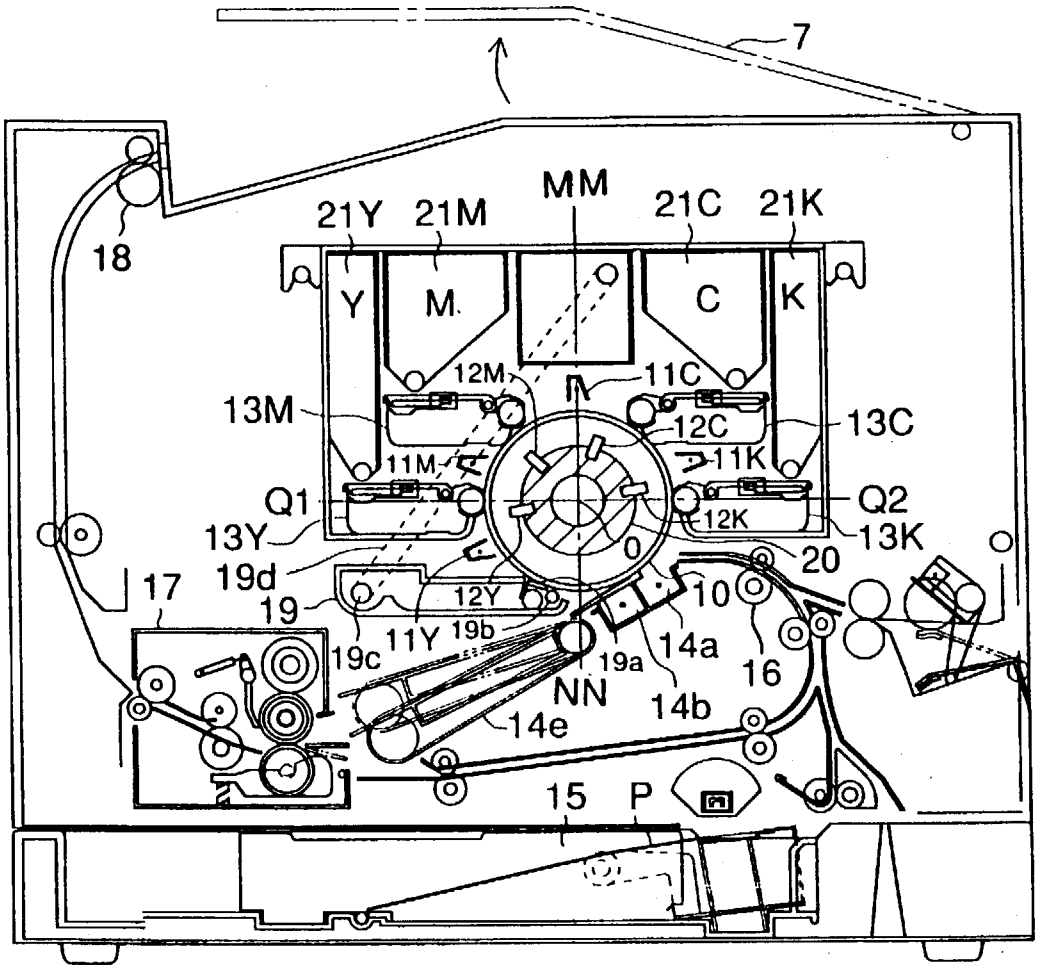
FIG. 20 is a sectional view showing the structure of a color image forming apparatus in the first embodiment for attaining the third object of the present invention.
Figure 21:
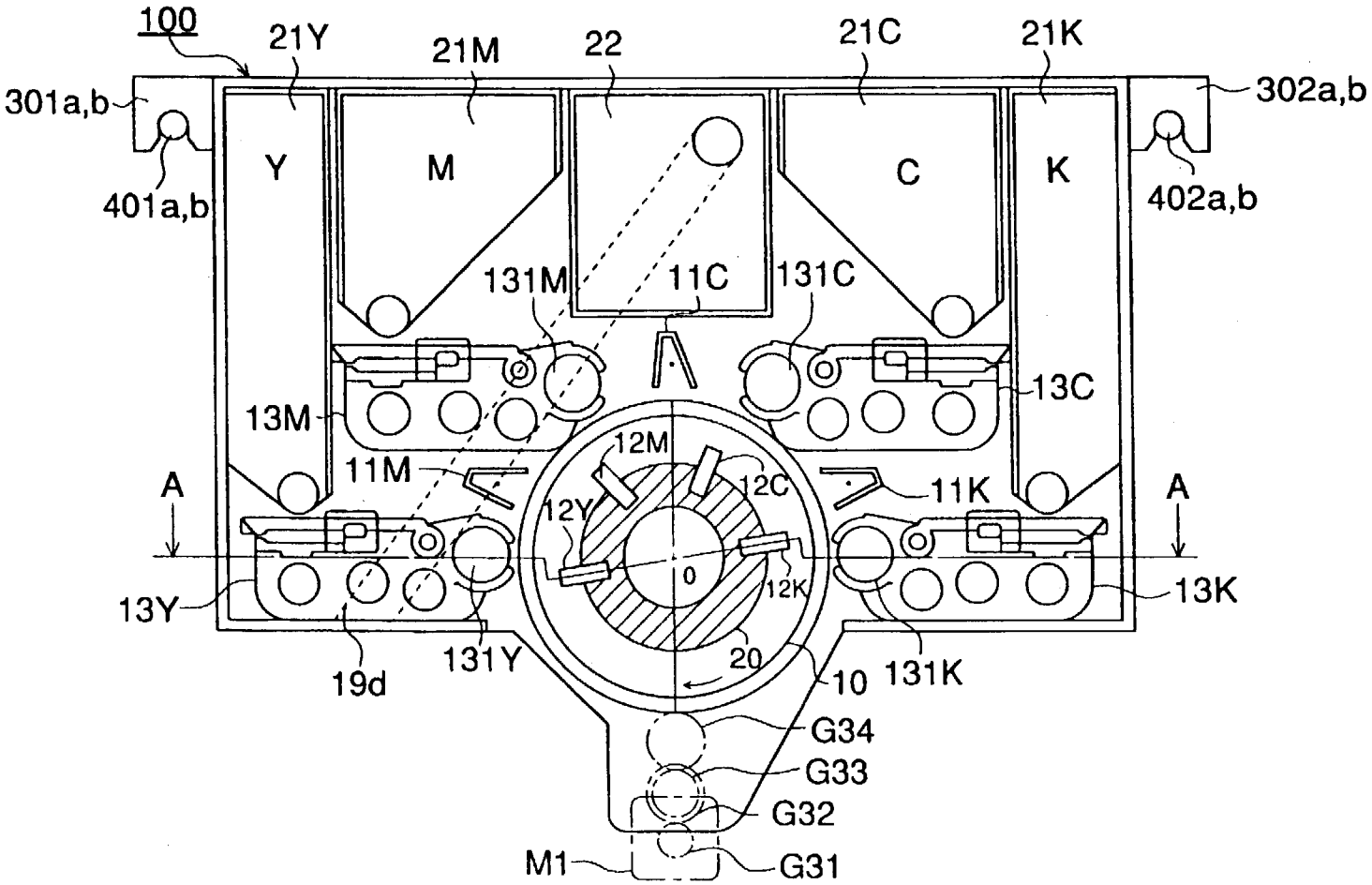
FIG. 21 is a sectional view of the process unit provided in the main portion shown in FIG. 20.
Figure 22:
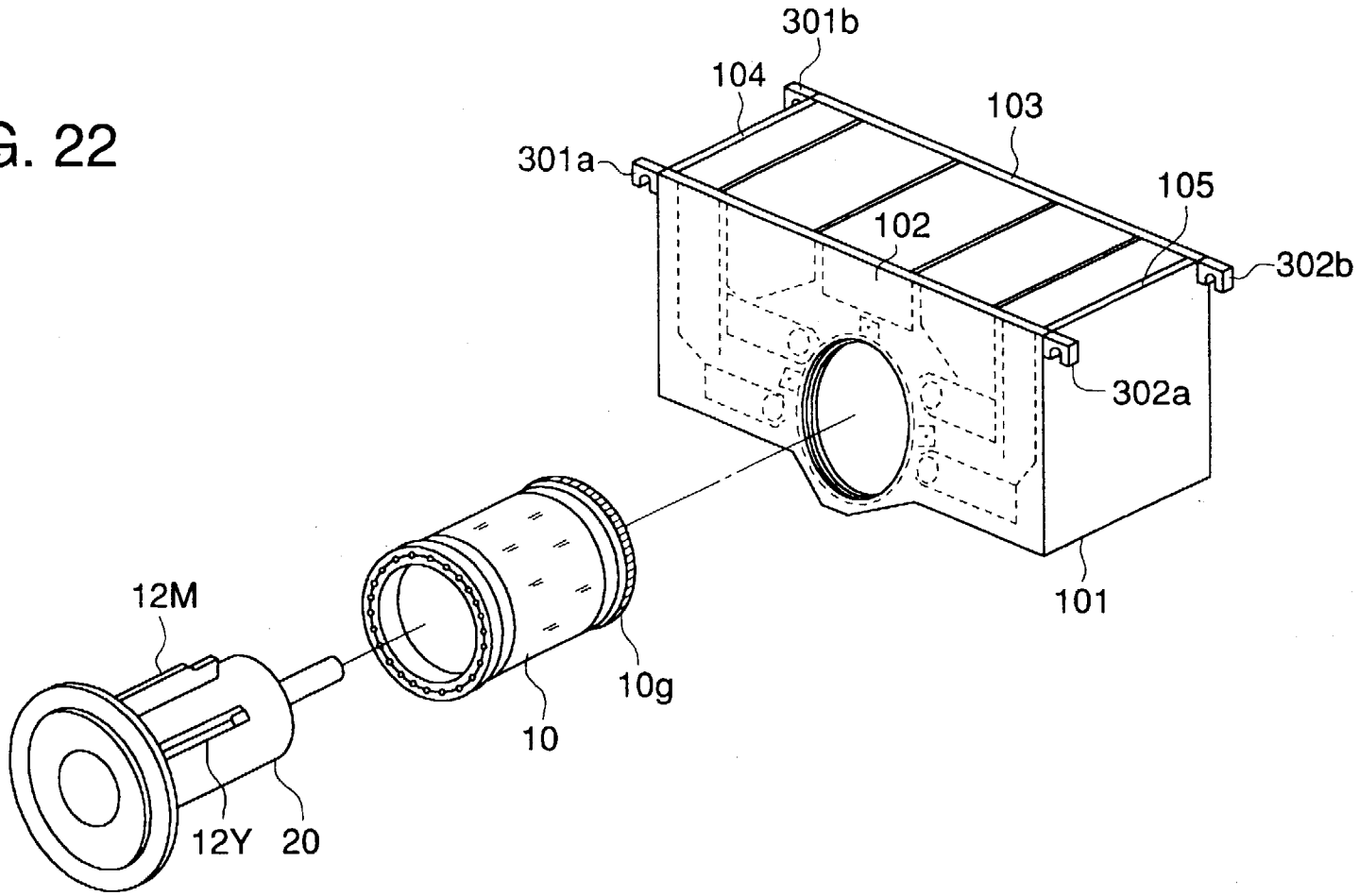
FIG. 22 is a view of the outline structure showing the assembled structure of the process cartridge.
Figure 23:
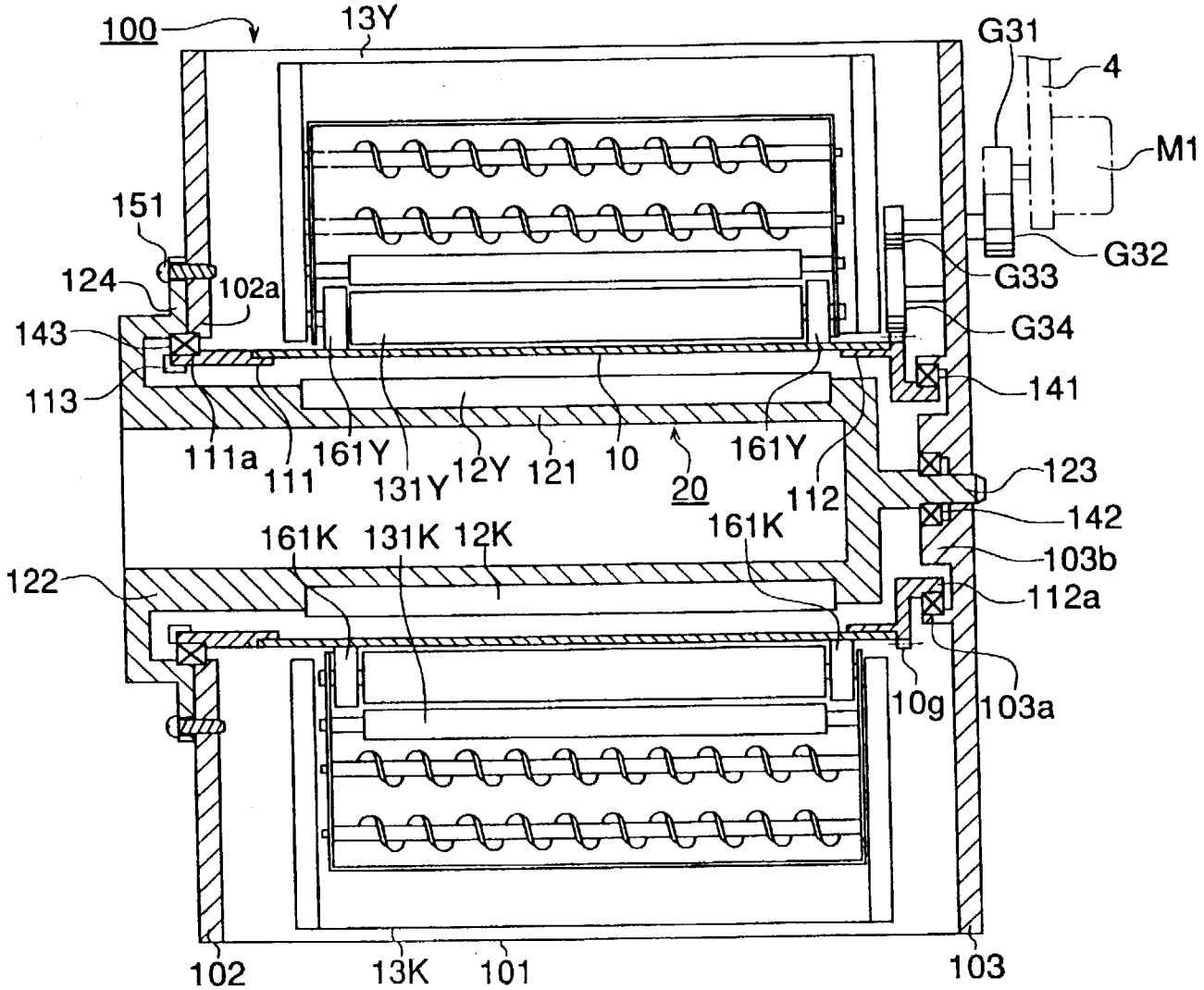
FIG. 23 is a sectional view showing the outline structure of the process unit taken on line A-O-A of FIG. 21.

Referring to FIGS. 20 to 25, the structure of main portions of the first embodiment of the color image forming apparatus to attain the third object of the present invention, will now be described. FIG. 21 is a sectional view of the process unit provided in a main portion in FIG. 20, according to this embodiment. FIG. 22 is a view showing the general structure of the assembled process unit. FIG. 23 is a sectional view showing the general structure of the process unit taken on line A-O-A in FIG. 21.

In this embodiment, a drum gear 10*g*, which is the driving gear for the photoreceptor drum, is provided on the rear flange 112 of the photoreceptor drum 10. The rear flange 112 provided on the side on which the photoreceptor drum 10 is pivotally supported by a bearing 141 which is a separate bearing member, not on the side on which the photoreceptor drum 10 is supported by a bearing member which is common to the photoreceptor drum 10 and the supporting member 20, so that vibration generated when the photoreceptor drum 10, which is an image formation body, is driven, is not directly transmitted to the exposure optical systems 12Y, 12M, 12C and 12K. Thereby, any vibration during rotation of the photoreceptor drum 10 is absorbed by the base body of the photoreceptor drum 10. Accordingly, an image forming apparatus is realized by which an excellent image, in which highly accurate registration of the exposure optical system is maintained, is obtained. Specifically, a color image forming apparatus, in which excellent color image formation is carried out with an excellent superimposed toner image, can be realized.

Still further, as a main structure of the image formation process described in FIG. 20, the process unit 100 is structured such that: developing units 13Y, 13M and supply tanks 21Y, 21M are provided to the left portion of the vertical line MM-O-NN passing through the center of the photoreceptor drum 10; developing units 13C, 13K and supply tanks 21C and 21K are provided to the right portion of the vertical line MM-O-NN; a waste toner container 22 is provided in the upper portion in the process unit 100; and scorotron chargers 11M, 11C, 11K, which are charging means, are provided outside the photoreceptor drum 10. Developing units 13Y, 13M, 13C, 13K are provided such that rollers 161Y, 161M, 161C and 161K, provided on both ends of the developing units 13Y, 13M, 13C and 13K, are in contact with both end portions of the photoreceptor drum 10.

In developing units 13Y, 13M, 13C and 13K, the centers of the respective developing sleeves 131Y, 131M, 131C, 131K exist in the upper portion on the horizontal line Q1-O-Q2 passing through the center of the photoreceptor drum 10.

The process unit 100 is held in the apparatus main body such that holder pins 401*a* and 401*b* (not shown in the drawing), provided in the front and the rear portions of the left side of the apparatus main body of the color image forming apparatus, are engaged with holders 301*a* and 301*b*, provided in the front and the rear portions of the upper end portion of the left side of the process unit 100; and holder pins 402*a* and 402*b* (not shown in the drawing), provided in the front and the rear portions of the right side of the apparatus main body, are engaged with holders 302*a* and 302*b* provided in the front and rear portions of the upper end portion of the left side of the process unit 100. The process unit 100 can be mounted into or dismounted from the upper portion in the apparatus main body using a knob (not shown in the drawing) after a cover, provided on the upper surface of the apparatus main body, has been opened.

When process unit 100 is mounted in the apparatus main body, gears G34, G33, G32, provided on the rear side plate of the process unit 100, the gear G34 being engaged with the drum gear 10*g* formed on the outer periphery of the rear flange 112 of the photoreceptor drum 10, are engaged with a gear G31 fixed on the drum driving motor M1 which are provided on the rear panel 4 of the apparatus main body. Accordingly, the photoreceptor drum 10 can be rotated by the drive of the driving motor M1. Further, when the process unit 100 is mounted into or dismounted from the apparatus, a combined portion, not shown in the drawing, of a toner conveyance pipe 19*d* provided from the cleaning unit 19 to the waste toner container 22, is closed, so that any waste toner does not fall.

When the photoreceptor drum 10 or exposure optical systems 12Y, 12M, 12c and 12K are maintained or replaced, the cover 7 provided on the upper surface of the apparatus main body is opened and closed, and the process unit 100 is pulled out from the apparatus main body. In this case, supply tanks 21Y, 21M, 21C and 21K and the waste toner container 22, which are provided in the upper portion in the process unit 100, are removed upward from the process unit 100, and further, developing units 13M, 13C, scorotron chargers 11M, 11K, developing units 13Y, 13K are removed upward from the process unit 100. After that, the supporting member 20 on which exposure optical systems 12Y, 12M, 12C and 12K are provided, and the photoreceptor drum 10 are pulled out in front of the process unit 100 for maintenance and replacement.

Figure 24:
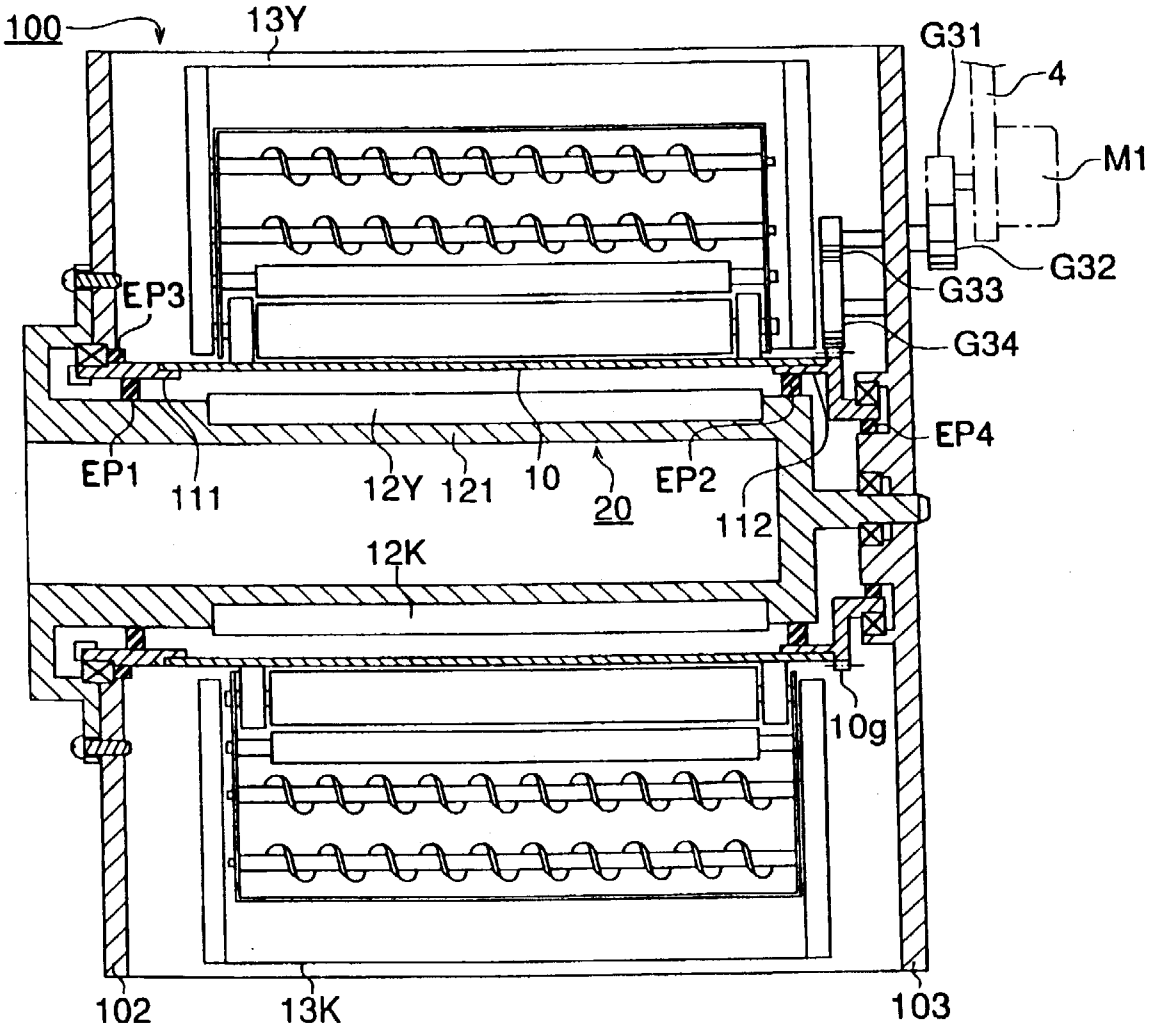
FIG. 24 is a sectional view showing the outline structure of the process unit in the second embodiment for attaining the third object of the present invention.

The second embodiment to attain the third object of the present invention will be described below using the process unit 100 in FIG. 24.

In the second embodiment, as in the first embodiment, the process unit can be mounted in or dismounted from the apparatus main body of the color image forming apparatus, and a braking member, to brake the rotation of the image forming body or absorb vibrations, is provided between the image forming body and the supporting member on which exposure optical systems, which are image exposure means, are provided. More preferably, an elastic braking member is provided between the image forming body and the frame body holding the image exposure means. The process and structure of the image forming apparatus described in FIGS. 20 to 23, are the same as those in the first embodiment.

The photoreceptor drum 10 is held by the rear flange 112 on which the photoreceptor drum driving gear 10*g* is provided, and the front flange 111. The gear 10*g* is driven by the drum driving motor M1 provided on the rear panel 4 of the apparatus main body, so that the photoreceptor drum 10 is rotated.

Ring-shaped elastic members EP1 and EP2, which are donut-type braking members, or braking members in which cut-out portions are provided on the inner or the outer periphery of the members, and which are formed of, for example, rubber, sponge, etc., made of neoprene, butadiene, isoprene, urethane, silicone, or gelled members made of silicone, etc., are provided between the front flange 111 by which the photoreceptor drum 10 which is an image forming body, is held, and a cylindrical portion 121 of the supporting member 20, and between the rear flange 112 and the cylindrical portion 121, wherein the exposure optical systems 12Y, 12M, 12C and 12K are provided on the supporting body 20, and the supporting body 20 is fixed by the front side plate 102 which is a frame body. The elastic members EP1 and EP2 provide the braking action when the photoreceptor drum 10 is rotated by the drum driving motor M1, prevent rotational fluctuation of the photoreceptor drum 10, and also absorb vibrations from the developing units, or the like.

The elastic member, provided between the exposure optical systems and the image forming body as a braking member, has effects in which vibrations entering into the exposure optical systems through the common bearing member or the bearing member close to the exposure optical system, are absorbed.

Further, ring-shaped elastic members EP3 and EP4, which are donut-type braking members or braking members in which cut-out portions are provided on the inner or the outer periphery of the members, and which are formed of, for example, rubber, sponge, etc., made of neoprene, butadiene, isoprene, urethane, silicone, or gelled members made of silicone, etc., are provided between the front flange 111 of the photoreceptor drum 10 and the front side plate 102 which is a frame body, and between the rear flange 112 and the rear side plate 103 which is a frame body. Thereby, vibrations from the developing units are prevented, the rotation of the photoreceptor drum 10 by the drum driving motor M1 is braked, or vibrations when the photoreceptor drum 10 is rotated are prevented. Transmission of vibrations to the exposure optical systems is prevented, in the same way as described above, and rotational fluctuations of the photoreceptor drum 10 are prevented.

Figure 25:
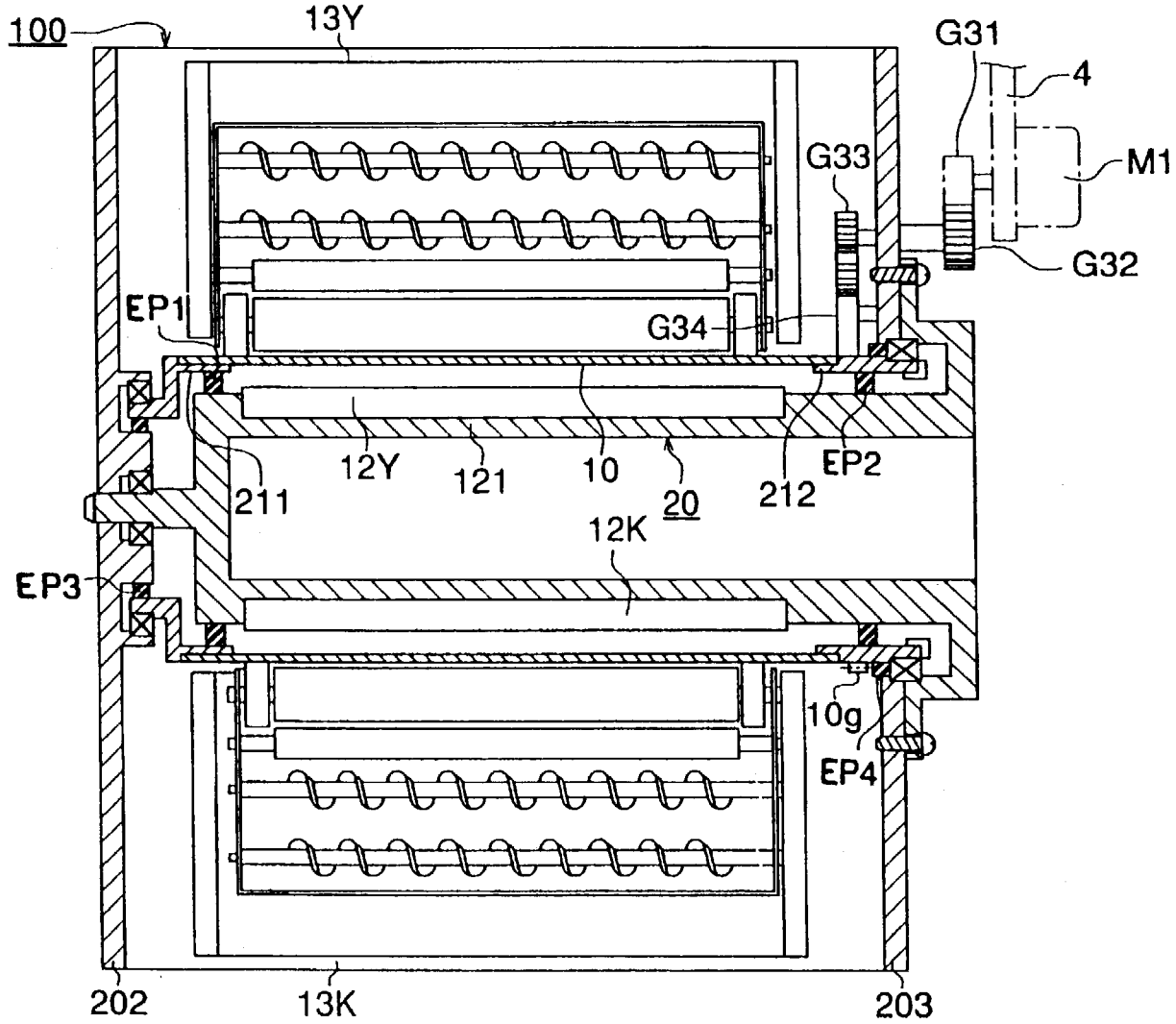
FIG. 25 is a sectional view showing the outline structure of the process unit in another embodiment of the second embodiment.

Another example of the second embodiment will be described below using the process unit 100 in FIG. 25.

In this example, the front and rear of the process unit 100 in the above-described example are reversed, and the process unit 100 is detachably provided in the apparatus main body of the color image forming apparatus. In the same way as in the first embodiment, the elastic braking member is provided between the image forming body and the supporting member on which the exposure optical systems which are the image exposure means, are provided. Further, more preferably, the elastic braking member is provided between the image forming body and the frame body holding the image exposure means. The processes and structure of the image forming apparatus described in FIGS. 20 to 23 are the same as those in the first embodiment.

The photoreceptor drum 10 is held by the rear flange 212, on which the photoreceptor drum driving gear 10*g* is provided, and the front flange 211, and the gear 10*g* is driven by the drum driving motor M1 provided on the rear panel 4 of the apparatus main body, and thereby, the photoreceptor drum 10 is rotated.

Ring-shaped elastic members EP1 and EP2, which are donut-type braking members, or braking members in which cut-out portions are provided on the inner or the outer periphery of the members, and which are formed of, for example, rubber, sponge, etc., made of neoprene, butadiene, isoprene, urethane, silicone, or gelled members made of silicone, etc., are provided between the front flange 211, by which the photoreceptor drum 10 which is an image forming body, is held, and a cylindrical portion 121 of the supporting member 20, and between the rear flange 212 and the cylindrical portion 121, wherein the exposure optical systems 12Y, 12M, 12C and 12K are provided on the supporting body 20, and the supporting body 20 is fixed by the rear side plate 203 which is a frame body. The elastic members EP1 and EP2 provide the braking action when the photoreceptor drum 10 is rotated by the drum driving motor M1, prevent rotational fluctuations of the photoreceptor drum 10, and absorb vibrations caused by developing units, or the like. The elastic braking members, provided between the exposure optical systems and the image forming body, has an effect in which vibrations entering into the exposure optical systems through the common bearing member or the bearing member close to the exposure optical system, are absorbed.

Further, ring-shaped elastic members EP3 and EP4, which are donut-type braking members or braking members in which cut-out portions are provided on the inner or the outer periphery of the members, and which are formed of, for example, rubber, sponge, etc., made of neoprene, butadiene, isoprene, urethane, silicone, or gelled members made of silicone, etc., are provided between the front flange 211 of the photoreceptor drum 10 and the front side plate 202 which is a frame body, and between the rear flange 212 and the rear side plate 203 which is a frame body. Thereby, vibrations from the developing units are prevented, the rotation of the photoreceptor drum 10 by the drum driving motor M1 is braked, or vibrations when the photoreceptor drum 10 is rotated are prevented, and transmission of the vibrations to the exposure optical systems is prevented, in the same way as described above, and the rotational fluctuations of the photoreceptor drum 10 are prevented.

In this connection, the image forming body used in the present invention is not limited to the photoreceptor drum described in the embodiment, but may be a belt-shaped photoreceptor.

Due to the above embodiment, the image carrier and the exposure optical systems are positioned in such a manner that the common bearing member is used as the reference on one side, and individual bearing members are used as the reference on the other side. The image carrier and the exposure optical system are fixed and positioned under the condition that the axial center of the image carrier coincides with that of the exposure optical system. The exposure optical system is extremely accurately positioned with respect to the photoreceptor drum which is the image forming body, and the positional relationship between the two apparatus is maintained even while these are assembled or used. Thereby, an image forming apparatus producing excellent images, in which accurate registration of the exposure optical system is maintained, is realized. Specifically, a color image forming apparatus can be realized by which the color image formation, in which an excellent superimposed toner image is obtained, is carried out.

A gear for driving the image formation body is provided on the end portion of the image forming body on the side of which the image forming body and the exposure optical system are respectively supported by individual bearing members, not on the side of which they are supported by the common bearing, so that vibrations when the image forming body is driven, are not directly transmitted to the exposure optical system. Thereby, any vibrations caused when the image forming body is driven, are absorbed by the base body of the image forming body. Accordingly, an image forming apparatus can be realized in which vibration-fluctuations of the exposure optical system do not occur, and highly accurate registration is maintained. Specifically, a color image forming apparatus can be realized in which the color image formation is carried out with an excellent superimposed toner image.

The braking member brakes and minimizes vibrations caused when the image carrier and developing units are driven. As a result, an image forming apparatus can be realized in which: rotational fluctuations of the image carrier, or the vibrations of the exposure optical systems are prevented; an excellent uniform image is obtained; and specifically, a color image forming apparatus can be realized, in which an excellent color image is obtained when toner images are superimposed.

Although the process unit is vertically attached into and detached from the color image forming apparatus shown in FIG. 1, an example in which the process unit is horizontally attached into and detached from the apparatus will be described below, referring to FIGS. 26 to 28.

Figure 26:
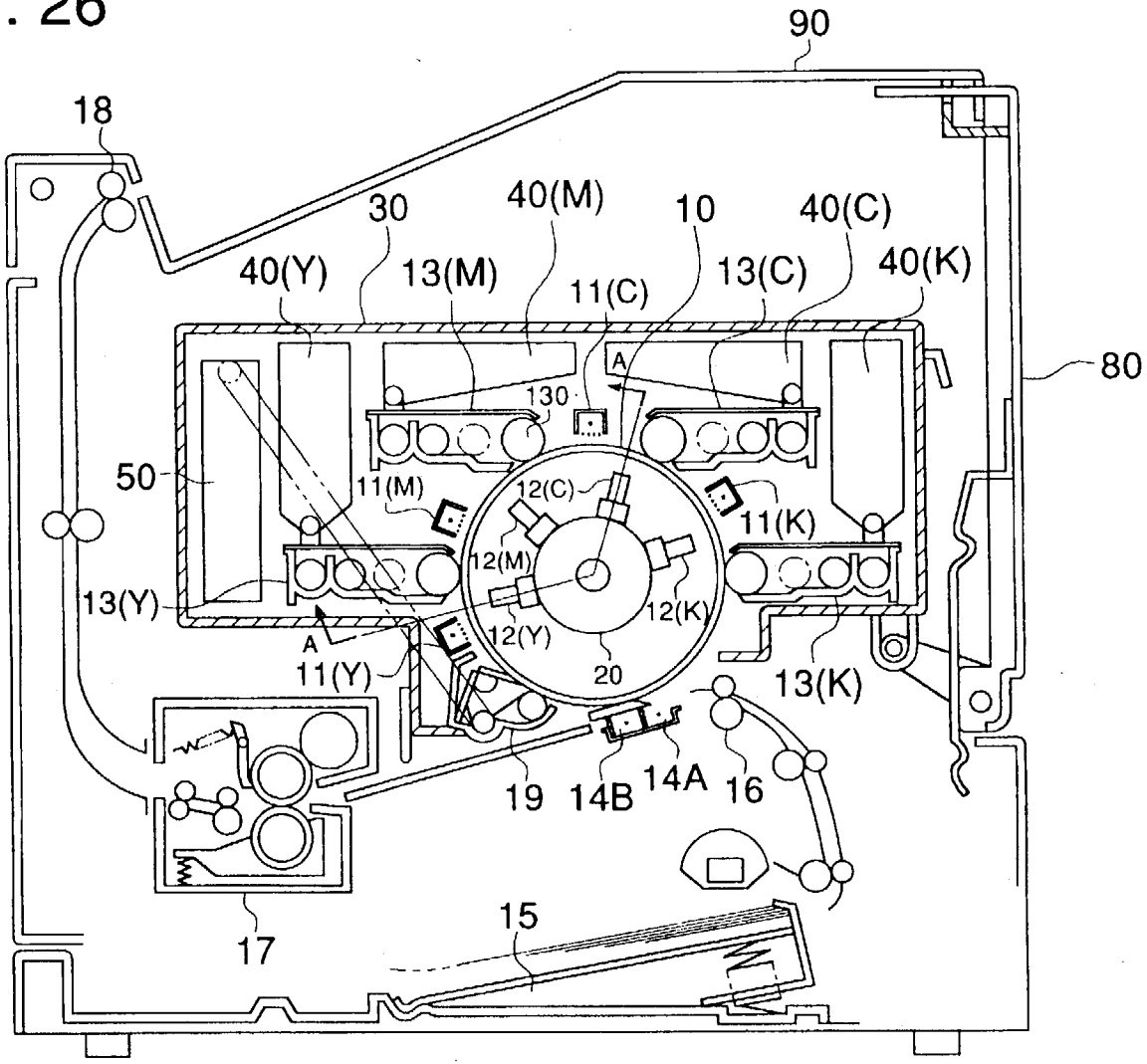
FIG. 26 is a sectional view of the color image forming apparatus according to the present invention.

In the color image forming apparatus shown in FIG. 26, the photoreceptor drum 10 is accommodated in the process cartridge together with chargers 11, developing units 13, cleaning unit 19, toner storage tanks 40(Y), 40(M), 40(C), 40(K) to supply toners to developing units 13, and a waste toner container to store toner collected from the cleaning unit 19. The process cartridge is structured such that it is pulled out horizontally from the apparatus main body, and further, it can be taken outside the apparatus main body.

When a side cover 80, forming the side member of the apparatus main body, is opened, the process cartridge 30 is initially moved obliquely upward, and it is pulled out, and then, the process cartridge 30 is horizontally moved outside the apparatus main body.

Figure 27:
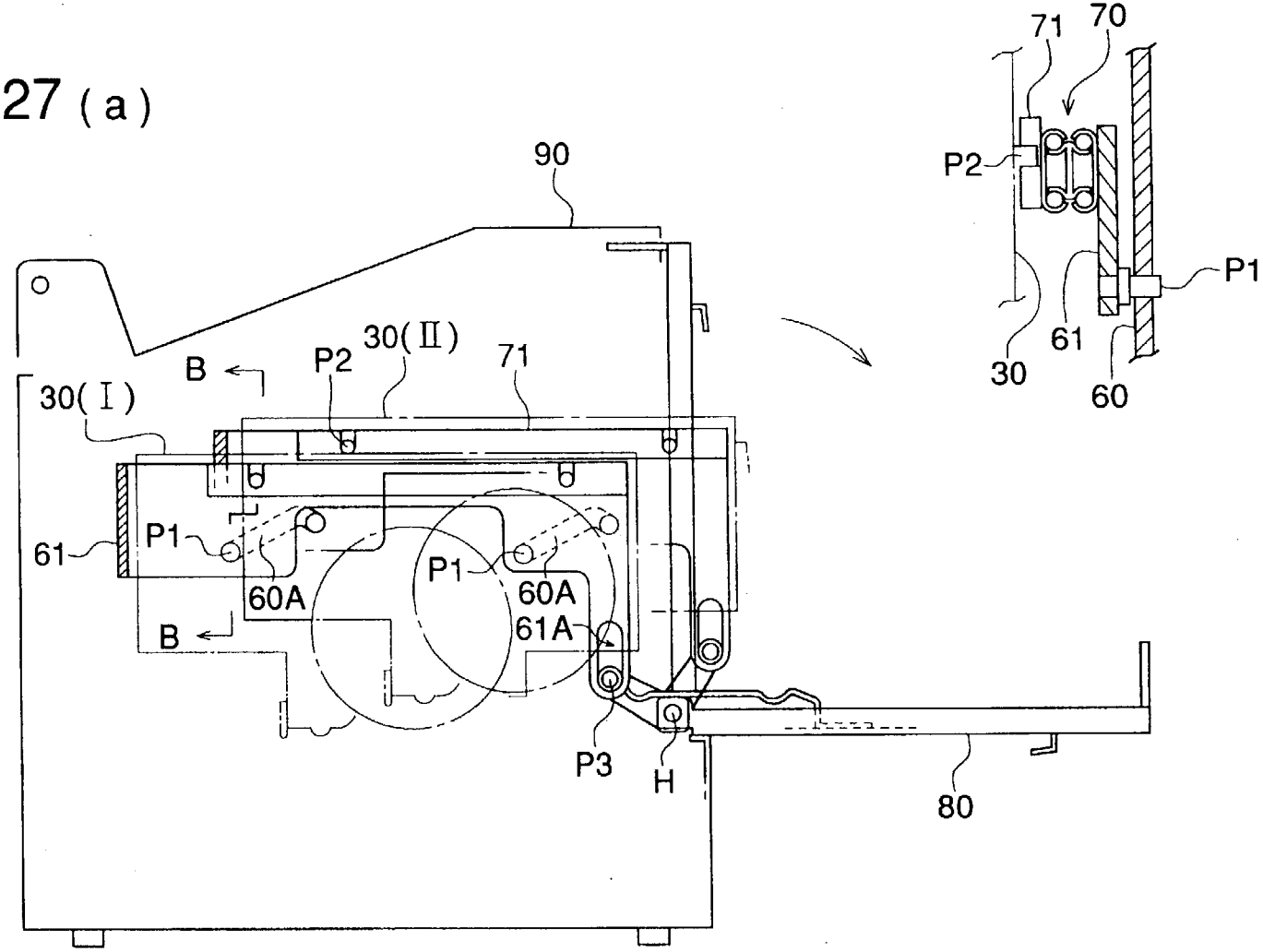
FIG. 27 is an illustration showing the relationship of the image formation position and the pulled-out position of the process cartridge.

FIG. 27(*a*) shows the structure for supporting the process cartridge 30, and FIG. 27(*b*) is the sectional view of the main portion taken on line BB in FIG. 27(*a*). A pair of inclined long holes 60A are provided, facing to each other, on the front and on the rear base plates in the apparatus main body. When a pin P1 is engaged into the long hole 60A from the inner side of the apparatus, a pair of joined elevation plates 61 are supported so that they can obliquely slide downward from the upper right or upper left position.

Guide members 70 which can extend and telescope in two steps by 3 rails which are called "accuride" rails, are provided inside of the elevation plates 61. Further, moving plates 71 are fixed on each inside rail.

A pair of U-shaped cutouts are provided on horizontally symmetrical positions of the moving plates 71. When pins P2 are engaged with their respective cutouts, the process cartridge 30 is securely supported.

The above-described elevation plates 61 are vertically provided with long holes 61A, and pins P3, provided on an arm rotating around the rotation shaft H together with the side cover 80, are loosely engaged with the long holes 61A.

When the side cover 80 is rotated clockwise, opened, and stopped at the horizontal stop position, and the pins P3 are moved, then the elevation plates 61 move obliquely downward from an upper oblique position when the pins P1 slide in the long hole 60A, and after that, the elevation plates 61 stop. In this process, the process cartridge 30 is moved, avoiding the timing roller 16, transfer unit 14A, and discharger 14B, from the image formation position (I) to the pull-out position (II), and is set to the position (II).

Figure 28:
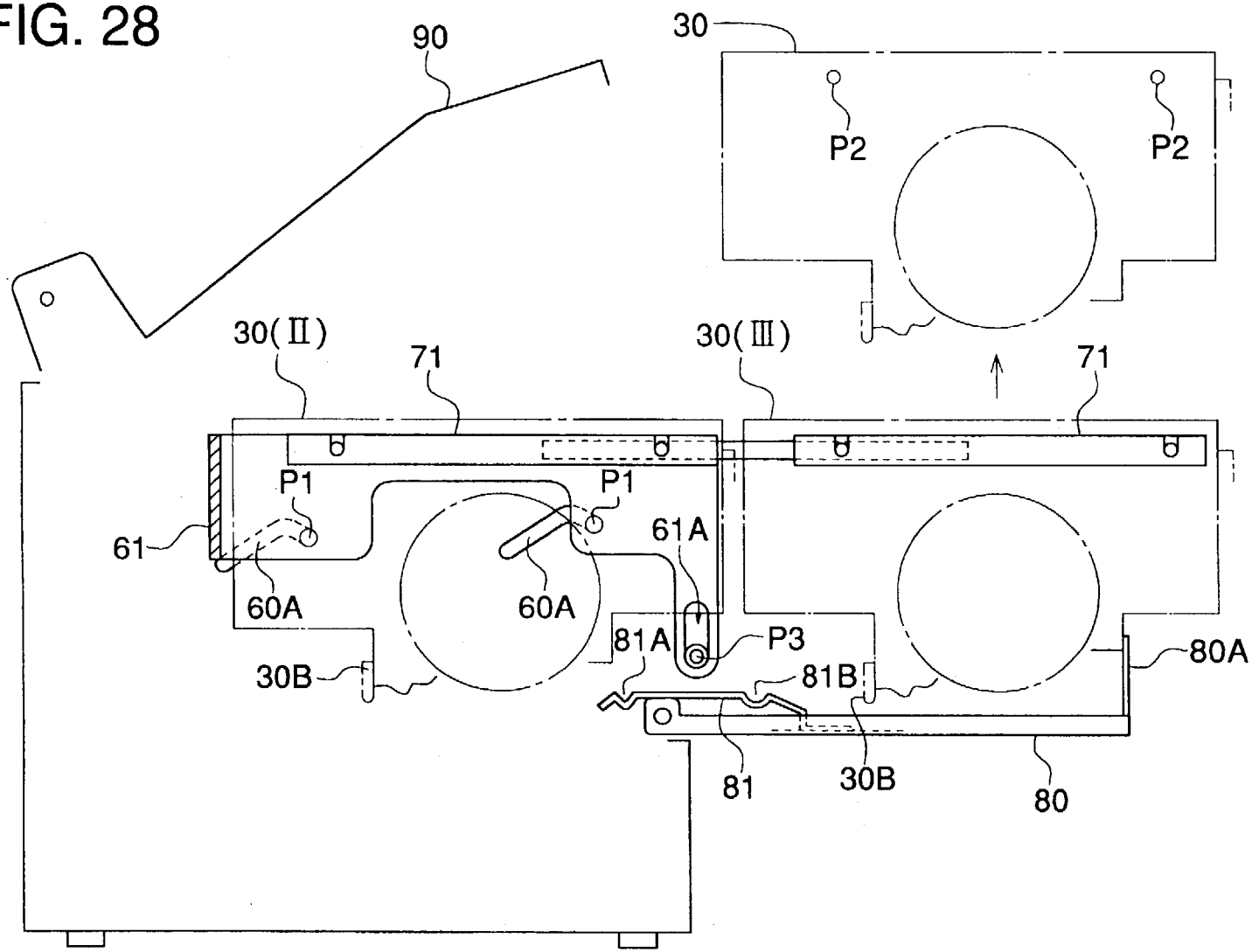
FIG. 28 is an illustration showing a structure for pulling-out the process cartridge and a restriction for moving the process cartridge to a specified position.

When the process cartridge 30 is pulled out from the pull-out position (II), the process cartridge 30 is moved outside the apparatus main body by extension and telescopic motion of the guide member 70, while being horizontally maintained as shown in FIG. 28. In this process, holding members 30B on the lower end of the cartridge 30 are successively engaged with recessed portions 81A and 81B of the elastic member 81 provided on the inner surface of the side cover 80, and the cartridge 30 is restricted to stop at a specified position.

That is, at the position at which the holding member 30B is engaged with the recessed portion 81A of the elastic member 81, the transfer area of the image in the apparatus main body is opened, and jammed sheets can be removed when the upper cover 90 is opened. At the position at which the holding member 30B is engaged with the recessed portion 81B, the exposure optical system 12 can be replaced from the rear of the cartridge 30. At the stop position (III) at which the cartridge 30 is further pulled out and comes into contact with the rising portion 80A of the side cover 80, the waste toner container 50 can be taken from the cartridge 30. Further, at the stop position (III), the pin P2 can be disengaged from the moving plate 71, and the cartridge 30 itself is separated upward and completely removed from the apparatus.

When the process cartridge 30 which is restricted to stop at the specified position and is in the stopped status, is moved and pushed back into the apparatus main body, then, the cartridge 30 returns to the pull-out position by the telescopic action of the guide member 70. During this time, the elevation plate 61 is maintained in the stationary status since the pin P1 is engaged at the end portion of the long hole 60A of the base plate 60 by the weight of the elevation plate 61. Next, when the side cover 80 is rotated counterclockwise to close the cover, and returns to the vertical position, the elevation plate 61 is moved obliquely downward from the upper oblique position by the movement of the pin P3 and stops at the initial position when the pin P1 slides in the long hole 60A. Thereby, the process cartridge 30 returns again to the image formation position (I) without contacting with the transfer unit 14A or the like.

Accordingly, maintenance operations such as inspection or replacement of the process cartridge 30, removing jammed sheet, toner supply or waste toner collection, can be easily carried out from only one side of the apparatus main body.

What is claimed is:

1. An apparatus for forming multi color toner images, comprising:

a photoreceptor drum having an opening at a first end through which an inside of the photoreceptor drum is accessible, and an outer surface on which multi color toner images are formed;

a supporting member capable of being inserted into the inside of the photoreceptor drum through the opening;

a cover member, provided on a first end of the supporting member, for covering the opening;

a plurality of exposing devices mounted on the supporting member so that the plurality of exposing devices and the supporting member are incorporated inside the photoreceptor drum when the cover member is fixed so as to cover the opening;

a plurality of charging devices, provided around the outer surface of the photoreceptor drum, for charging the outer surface of the photoreceptor drum;

wherein said plurality of exposing devices conduct image-wise exposing inside the photoreceptor drum so as to form a plurality of latent images for plural different colors on the charged outer surface of the photoreceptor drum; and further comprising a plurality of developing devices, provided around the outer surface of the photoreceptor drum, for developing the plurality of latent images with plural different color toners so that multi color toner images are formed on the outer surface of the photoreceptor drum.

2. The apparatus of claim 1, wherein the supporting member includes a hollow portion which penetrates the cover member.

3. The apparatus of claim 1, wherein the cover member is engaged with the first end of the photoreceptor drum together with a bearing member having an outer peripheral surface and an inner peripheral surface.

4. The apparatus of claim 3, wherein the outer peripheral surface of the bearing member is engaged with the supporting member, and the inner peripheral surface of the bearing member is engaged with the first end of the photoreceptor drum.

5. The apparatus of claim 1, wherein:

a disk member having a hole is connected to a second end of the photoreceptor drum;

a second end of the supporting member is shaped in the form of a shaft which is engaged with the hole of the disk member together with a bearing member having an outer peripheral surface and an inner peripheral surface; and the inner peripheral surface of the bearing member is engaged with the shaft, and the outer peripheral surface of the bearing member is engaged with the hole of the disk member.

6. The apparatus of claim 1, wherein:

a second end of the photoreceptor drum is supported by a bearing member provided independently of the supporting member; and a gear for driving the photoreceptor drum is provided on a second end of the photoreceptor drum.

7. The apparatus of claim 1, further comprising a braking member for reducing vibration of the photoreceptor drum.

8. The apparatus of claim 7, wherein the braking member comprises an elastic member.

9. The apparatus of claim 8, wherein the elastic member comprises one of rubber and sponge.

10. The apparatus of claim 8, wherein the elastic member comprises a gel-like substance.

11. The apparatus of claim 7, wherein the braking member is provided between one of: i) the photoreceptor drum and the supporting member, and ii) the photoreceptor drum and a stationary section.

12. An apparatus for forming multi color toner images, comprising:

a photoreceptor drum having an opening at a first end through which an inside of the photoreceptor drum is accessible, and an outer surface on which multi color toner images are formed;

a supporting member capable of being inserted into the inside of the photoreceptor drum through the opening;

a plurality of exposing devices mounted on the supporting member so that the plurality of exposing devices are incorporated together with the supporting member inside the photoreceptor drum;

a protection guide device for protecting an inner surface of the photoreceptor drum when the plurality of exposing devices are incorporated inside the photoreceptor drum;

a plurality of charging devices, provided around the outer surface of the photoreceptor drum, for charging the outer surface of the photoreceptor drum;

wherein the plurality of exposing devices conduct image-wise exposing inside the photoreceptor drum so as to form a plurality of latent images for plural different colors on the charged outer surface of the photoreceptor drum; and further comprising a plurality of developing devices, provided around the outer surface of the photoreceptor drum, for developing the plurality of latent images with plural different color toners so that multi color toner images are formed on the outer surface of the photoreceptor drum.

13. The apparatus of claim 12, wherein the protection guide device is mounted on the supporting member at a position between the plurality of exposing devices.

14. The apparatus of claim 13, wherein the protection guide device is located closer to an internal surface of the photoreceptor drum than the plurality of exposing devices.

15. The apparatus of claim 12, wherein the protection guide device comprises an elastic member.

16. The apparatus of claim 12, further comprising a process unit which is detachably mounted in the apparatus, and wherein the photoreceptor drum and the plurality of exposing devices are provided in the process unit, and the plurality of exposing devices and the protection guide device are one of: i) mounted in, and ii) dismounted from the inside of the photoreceptor drum together with the supporting member after the process unit is dismounted from the photoreceptor drum.

17. The apparatus of claim 12, wherein the protection guide device comprises a plurality of protection members arranged in an axial direction of the supporting member.

18. The apparatus of claim 12, wherein:

the supporting member includes a through hole extending in the axial direction;

a guide shaft capable of being inserted in the through hole of the supporting member is provided inside the photoreceptor drum; and the plurality of exposing devices are incorporated inside the photoreceptor drum while the through hole of the supporting member passes along the guide shaft.

19. The apparatus of claim 18, wherein:

bearing members are provided on both end portions of the photoreceptor drum; and the supporting member and the plurality of exposing devices are fixed together with the guide shaft by a fixing member while positions of the bearing members are taken as reference positions.

20. The apparatus of claim 19, wherein the supporting member and the fixing member are integrally formed as a single body.

* * * * *